US008573429B2

(12) United States Patent
Hawkins

(10) Patent No.: US 8,573,429 B2
(45) Date of Patent: Nov. 5, 2013

(54) BIN

(75) Inventor: Laura L. Hawkins, Minneapolis, MN (US)

(73) Assignee: Target Brands, Inc., Minneapolis, MN (US)

( * ) Notice: Subject to any disclaimer, the term of this patent is extended or adjusted under 35 U.S.C. 154(b) by 167 days.

(21) Appl. No.: 13/194,637

(22) Filed: Jul. 29, 2011

(65) Prior Publication Data

US 2013/0026163 A1 Jan. 31, 2013

(51) Int. Cl.
*B65D 21/00* (2006.01)

(52) U.S. Cl.
USPC ..... 220/23.4; 220/23.83; 220/23.86; 220/23.88; 220/507; 220/23.89; 229/125.28; 229/125.38; 229/116.1; 229/4.5; 211/133.1; 211/128.1; 47/41.01

(58) Field of Classification Search
USPC ..... 220/23.4, 507, 23.83–23.89; 229/125.28, 125.38, 116.1, 4.5
See application file for complete search history.

(56) References Cited

U.S. PATENT DOCUMENTS

| | | | | | |
|---|---|---|---|---|---|
| 105,269 | A | | 7/1870 | Spencer | |
| 265,836 | A | | 10/1882 | Lindner | |
| 333,643 | A | | 1/1886 | Lewis | |
| 731,710 | A | * | 6/1903 | Renken | 211/74 |
| 979,261 | A | | 12/1910 | Compton | |
| 1,113,350 | A | | 10/1914 | Inman | |
| 1,270,554 | A | * | 6/1918 | Rubel | 206/423 |
| 2,022,601 | A | | 11/1935 | McDonald | |
| 2,079,177 | A | * | 5/1937 | Membrino | 229/93 |
| 2,080,105 | A | | 5/1937 | Bacon | |
| D106,202 | S | * | 9/1937 | Kane | D9/414 |
| 2,275,542 | A | | 3/1942 | Menges | |
| 2,283,406 | A | * | 5/1942 | Bacon | 248/174 |
| 2,300,473 | A | * | 11/1942 | Winkle Van | 229/4.5 |
| 2,329,605 | A | | 9/1943 | Gladstein | |
| 2,340,373 | A | | 2/1944 | Gardner | |
| 2,458,578 | A | | 1/1949 | Evans | |
| 2,540,707 | A | | 2/1951 | Beukelman | |
| 2,713,740 | A | | 7/1955 | Fessenden et al. | |
| 3,131,511 | A | * | 5/1964 | Deaner | 47/41.01 |
| 3,134,485 | A | * | 5/1964 | Bonkowski | 206/159 |
| 3,225,805 | A | * | 12/1965 | Wise | 150/118 |
| 3,305,161 | A | * | 2/1967 | Offer | 229/93 |
| 3,313,333 | A | | 4/1967 | Lordi | |
| 3,330,405 | A | | 7/1967 | Taub | |
| 3,370,773 | A | | 2/1968 | Mayo | |
| 3,376,666 | A | * | 4/1968 | Leonard | 47/41.01 |
| 3,554,434 | A | * | 1/1971 | Anderson | 383/104 |
| 3,734,275 | A | * | 5/1973 | Greene, III | 206/45.25 |
| 3,850,290 | A | * | 11/1974 | Murphy | 206/457 |
| D237,001 | S | | 9/1975 | Von Serda | |
| D244,259 | S | | 5/1977 | Bergstein | |
| 4,121,710 | A | * | 10/1978 | Murphy | 206/761 |
| D257,526 | S | * | 11/1980 | Herbst et al. | D7/509 |
| 4,252,264 | A | * | 2/1981 | Herbst et al. | 229/400 |

(Continued)

*Primary Examiner* — Mickey Yu
*Assistant Examiner* — Gideon Weinerth
(74) *Attorney, Agent, or Firm* — Leanne Taveggia Farrell; Westman, Champlin & Koehler, P.A.

(57) ABSTRACT

A retail display apparatus has a transparent inner cylinder with a top. An outer sleeve surrounds a portion of the transparent inner cylinder and has a top such that a first part of the top of the outer sleeve is a first distance from the top of the transparent inner cylinder and a second part of the top of the outer sleeve is a second distance from the top of the transparent inner cylinder.

18 Claims, 18 Drawing Sheets

(56) References Cited

U.S. PATENT DOCUMENTS

| | | | | | |
|---|---|---|---|---|---|
| 4,415,077 | A | * | 11/1983 | Murphy | 220/4.26 |
| 4,542,930 | A | * | 9/1985 | Adams | 294/160 |
| D283,592 | S | | 4/1986 | Quarrell et al. | |
| 4,608,776 | A | * | 9/1986 | Kooy | 47/58.1 R |
| 4,610,363 | A | * | 9/1986 | Flum et al. | 211/74 |
| 4,700,847 | A | | 10/1987 | Shieh | |
| D296,630 | S | * | 7/1988 | Renold et al. | D6/468 |
| 4,846,394 | A | | 7/1989 | Swanson | |
| 5,031,826 | A | | 7/1991 | Seufert | |
| 5,052,570 | A | | 10/1991 | Johansen | |
| D327,093 | S | | 6/1992 | Evenson | |
| D327,965 | S | | 7/1992 | Chelec | |
| 5,148,932 | A | * | 9/1992 | Orefice | 220/23.2 |
| D330,512 | S | * | 10/1992 | Ryberg | D9/414 |
| D333,025 | S | | 2/1993 | Doherty | |
| 5,228,569 | A | * | 7/1993 | House | 206/372 |
| 5,328,732 | A | | 7/1994 | Renna | |
| 5,372,269 | A | * | 12/1994 | Sutton et al. | 220/62 |
| D357,886 | S | | 5/1995 | Fuller | |
| 5,471,783 | A | | 12/1995 | McLean | |
| 5,544,764 | A | * | 8/1996 | Cima | 211/60.1 |
| D376,284 | S | | 12/1996 | Keeley | |
| 5,598,942 | A | * | 2/1997 | Cowie | 220/495.08 |
| D405,689 | S | | 2/1999 | Moon | |
| D411,676 | S | | 6/1999 | Cantrell | |
| D413,189 | S | | 8/1999 | Conti | |
| D417,616 | S | | 12/1999 | Conway | |
| 6,152,359 | A | | 11/2000 | Clark | |
| D436,312 | S | * | 1/2001 | Denbraver | D9/712 |
| D436,705 | S | | 1/2001 | Dow et al. | |
| 6,170,740 | B1 | | 1/2001 | Clark | |
| D446,684 | S | | 8/2001 | Price | |
| D450,456 | S | | 11/2001 | Warren, III | |
| D456,211 | S | | 4/2002 | Price | |
| 6,393,761 | B1 | * | 5/2002 | Deacon | 47/41.01 |
| D462,422 | S | | 9/2002 | Conner | |
| 6,453,605 | B1 | * | 9/2002 | Chien | 47/41.01 |
| D466,763 | S | | 12/2002 | Wu | |
| 6,594,953 | B2 | * | 7/2003 | Weder et al. | 47/75 |
| D489,501 | S | | 5/2004 | Dretzka | |
| D494,885 | S | * | 8/2004 | Rahme | D11/149 |
| D495,880 | S | | 9/2004 | Warren, III | |
| D521,202 | S | | 5/2006 | Lin | |
| D525,657 | S | | 7/2006 | Warren, III | |
| 7,090,116 | B2 | * | 8/2006 | Cutler et al. | 229/400 |
| 7,111,735 | B2 | | 9/2006 | Lowry | |
| D536,497 | S | | 2/2007 | Chiang | |
| D546,631 | S | | 7/2007 | Carey | |
| 7,625,488 | B2 | | 12/2009 | Blackburn | |
| D618,021 | S | | 6/2010 | Guindi | |
| D625,852 | S | | 10/2010 | Franklin | |
| D625,855 | S | | 10/2010 | Franklin | |
| D626,866 | S | | 11/2010 | Powers | |
| D631,580 | S | | 1/2011 | Franklin | |
| D631,581 | S | | 1/2011 | Franklin | |
| D632,651 | S | | 2/2011 | Foreman et al. | |
| D638,644 | S | | 5/2011 | Tawil | |
| D645,779 | S | | 9/2011 | Bradley et al. | |
| D675,442 | S | * | 2/2013 | Hawkins | D3/304 |
| D680,353 | S | * | 4/2013 | Hawkins | D6/682.4 |
| 2002/0157308 | A1 | * | 10/2002 | Hanis | 47/41.01 |
| 2002/0185525 | A1 | | 12/2002 | Hallam | |
| 2006/0289609 | A1 | | 12/2006 | Fritz et al. | |
| 2009/0145953 | A1 | | 6/2009 | Heinemann, III et al. | |
| 2009/0200200 | A1 | | 8/2009 | Trappani et al. | |
| 2010/0320262 | A1 | | 12/2010 | Tao | |
| 2012/0073192 | A1 | * | 3/2012 | Tiers | 47/41.01 |
| 2013/0167435 | A1 | * | 7/2013 | Weder | 47/41.01 |

* cited by examiner

BIN

BACKGROUND

In retail environments, loose items for sale are sometimes placed in bins or open boxes. These bins and boxes are often bulky to ship. In addition, because such bins and boxes often have opaque sides they obscure guests' views of the products.

The discussion above is merely provided for general background information and is not intended to be used as an aid in determining the scope of the claimed subject matter. The claimed subject matter is not limited to implementations that solve any or all disadvantages noted in the background.

SUMMARY

A retail display apparatus has a transparent inner cylinder with a top. An outer sleeve surrounds a portion of the transparent inner cylinder and has a top such that a first part of the top of the outer sleeve is a first distance from the top of the transparent inner cylinder and a second part of the top of the outer sleeve is a second distance from the top of the transparent inner cylinder.

A retail display unit includes a first sheet material formed in a flattened first tubular body and a second sheet material adapted to be formed into a second tubular body that fits within the first tubular body. The first sheet material has first and second score lines on opposing sides of the flattened first tubular body that permit the first tubular body to be flattened.

A container structure has a first container and a second container. The first container has a first outer sleeve that surrounds at least a portion of a first transparent inner sleeve, where the first transparent inner sleeve surrounds a first open space. The second container has a second outer sleeve that surrounds at least a portion of a second transparent inner sleeve, where the second transparent inner sleeve surrounds a second open space. At least one fastener passes through the first outer sleeve, the first transparent inner sleeve, the second outer sleeve and the second transparent inner sleeve to fasten the first container to the second container.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DETAILED DESCRIPTION

The embodiments described below provide a multi-part bin that can be shipped to a retail establishment in a flat form and can be assembled into a cylindrical or tubular body at the retail establishment. The multi-part bin is constructed from a clear plastic sheet and a collapsible outer paper tube. During assembly, the clear plastic sheet is rolled into a cylinder and is locked into that shape using a set of locking tabs on the sheet. The plastic cylinder is then inserted into a center of the outer paper tube. The plastic cylinder and the outer paper tube cooperate to provide a stable bin assembly. According to some embodiments, the height of the outer paper tube along at least a portion of the outer paper tube is less than the height of the plastic cylinder. This allows guests to see products held in the bin through a transparent side of the plastic cylinder.

According to one embodiment, the outer paper tube is made collapsible by two score lines on opposing sides of the paper tube. According to further embodiments, once a set of these bins has been constructed, the bins may be attached together by passing fasteners through the front, sides or backs of the bins. This forms a bin assembly with additional structural stability.

FIGS. 1-6 provide a perspective view, a front view, a back view, a right side view, a left side view, and a top view, respectively, of a retail display unit 100 according to some embodiments. Herein, the retail display unit may be referred to alternatively as part or all of a display unit, display apparatus, a bin, or a container.

Figure 7:
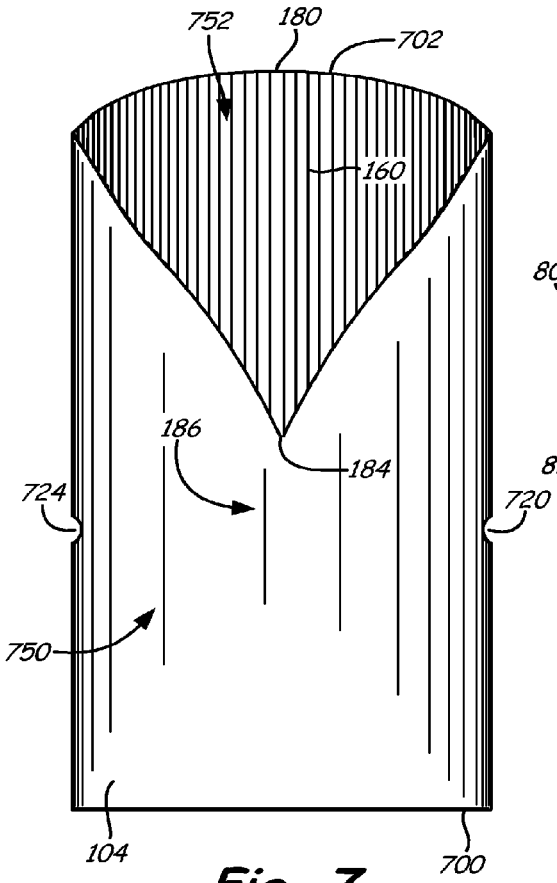
FIG. 7 is a front view of an outer sleeve of the retail display apparatus of FIG. 1 without the inner sleeve.
Figure 8:
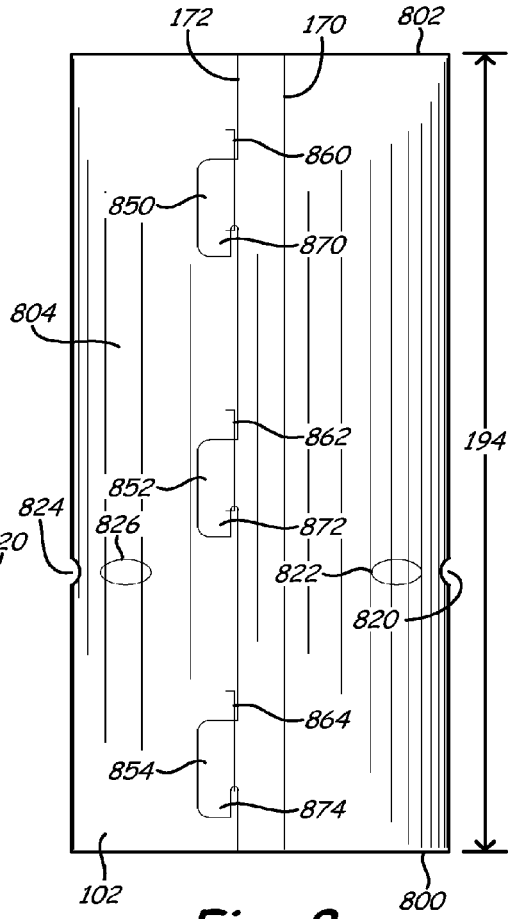
FIG. 8 is a front view of an inner sleeve of the retail display apparatus of FIG. 1 without the outer sleeve.
Figure 9:
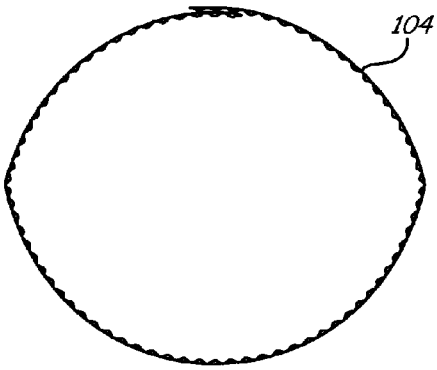
FIG. 9 is a top view of an outer sleeve of the retail display apparatus of FIG. 1 without the inner sleeve.
Figure 10:
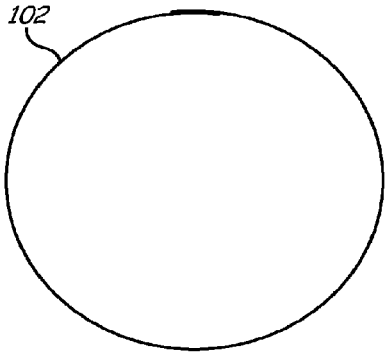
FIG. 10 is a top view of an inner sleeve of the retail display apparatus of FIG. 1 without the outer sleeve.

Display unit 100 includes an inner sleeve 102 and an outer sleeve 104. FIGS. 7 and 9 show a front view and top view, respectively, of outer sleeve 104 and FIGS. 8 and 10 show a front view and top view, respectively, of inner sleeve 102. Inner sleeve 102 is alternatively referred to as an inner cylinder or a tubular body. Outer sleeve 104 is alternatively referred to as an outer cylinder or a tubular body.

In FIGS. 1-10, inner sleeve 102 and outer sleeve 104 have a substantially circular cross-sectional shape (FIG. 6); however, according to other embodiments the cross-sectional shape of inner sleeve 102 and outer sleeve 104 may be substantially elliptical, substantially oval, or substantially polygonal. Inner sleeve 102 and outer sleeve 104 may have irregularities that keep them from having perfectly circular, elliptical, oval or polygonal cross-section shapes.

Figure 6:
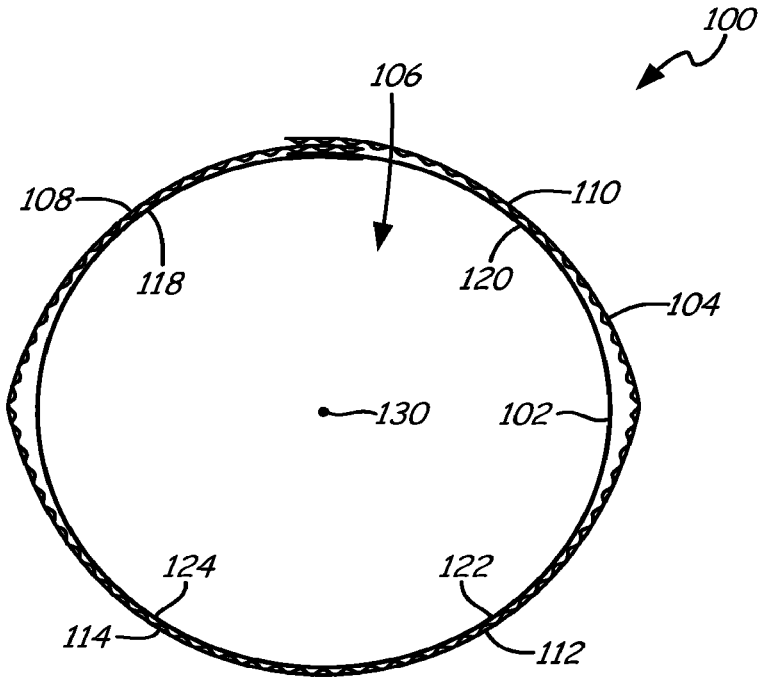
FIG. 6 is a top view of the retail display apparatus of FIG. 1.

Outer sleeve 104 surrounds at least a portion of inner sleeve 102, which in turn surrounds an open space 106 (FIG. 6). According to many embodiments, at least one portion of outer sleeve 104 is in contact with at least a portion of inner sleeve 102 such that outer sleeve 104 and inner sleeve 102 cooperate to provide structural stability to at least outer sleeve 104. For example, in FIG. 6, portions 108, 110, 112 and 114 of outer sleeve 104 are shown in contact with portions 118, 120, 122, and 124 of inner sleeve 102. Although FIGS. 1-6 show that portions of outer sleeve 104 are not in contact with inner sleeve 102, in other embodiments, an entire inner surface of outer sleeve 104 is in contact with inner sleeve 102. According to some embodiments, inner sleeve 102 is not bonded or attached to outer sleeve 104 and may be moved relative to outer sleeve 104 along a central axis 130.

Inner sleeve 102 has a bottom edge 800 (FIG. 8) and outer sleeve 104 has a bottom edge 700. Bottom edge 800 and bottom edge 700 are designed to rest on a surface such as a shelf or a floor and to thereby support inner sleeve 102 and outer sleeve 104, respectively. When bottom edge 800 and bottom edge 700 are both resting on a surface, they are aligned with one another.

According to one embodiment, inner sleeve 102 has a top edge or top 802 that is shaped substantially similar to bottom edge 800. In particular, both bottom edge 800 and top edge 802 are level such that substantially the entirety of bottom edge 800 resides in a single plane that is substantially orthogonal to sides 804 of inner sleeve 102 and such that substantially the entirety of top edge 802 resides in a single plane that is substantially orthogonal to sides 804. According to one embodiment, top edge 802 is a distance 194 (FIGS. 5 and 8) from bottom edge 800. According to other embodiments, top edge 802 may be shaped differently from bottom edge 800 and may, for example, reside in a plane that is not orthogonal to sides 804 of inner sleeve 102.

According to one embodiment, outer sleeve 104 has a top edge or top 702 that is shaped differently from bottom edge 700. In particular, bottom edge 700 is level such that substantially the entirety of bottom edge 700 resides in a single plane that is substantially orthogonal to sides 704 of outer sleeve 104. However, according to one embodiment, top edge 702 is shaped so that there is no plane that the entirety of top edge 702 resides within. According to the particular embodiment shown in FIGS. 1-6, 7 and 9, top edge 702 curves downward from a high point 180 at a back 182 of outer sleeve 104 to a low point 184 at a front 186 of outer sleeve 104. According to one embodiment, high point 180 is a distance/height 190 (FIG. 5) from bottom edge 700 and low point 182 is a distance/height 192 (FIG. 5) from bottom edge 700. In the embodiment of FIGS. 1-6, distances/heights 190 and 192 of outer sleeve 104 are less than distance/height 194 of inner sleeve 102. According to other embodiments, distance/height 190 may be the same as or greater than distance/height 194. Further, low point 184 of top 702 is a distance 400 (FIG. 4) from top 802 and high point 180 of top 702 is a distance 402 (FIG. 4) from top 802, where distance 400 is greater than distance 402.

The shape of top edge 702 exposes side 804 of inner sleeve 102, which extends above top edge 702. In embodiments where inner sleeve 102 is transparent, guests can see through exposed side 804 to view products (not shown) that are stored in display unit 100.

Figure 1:
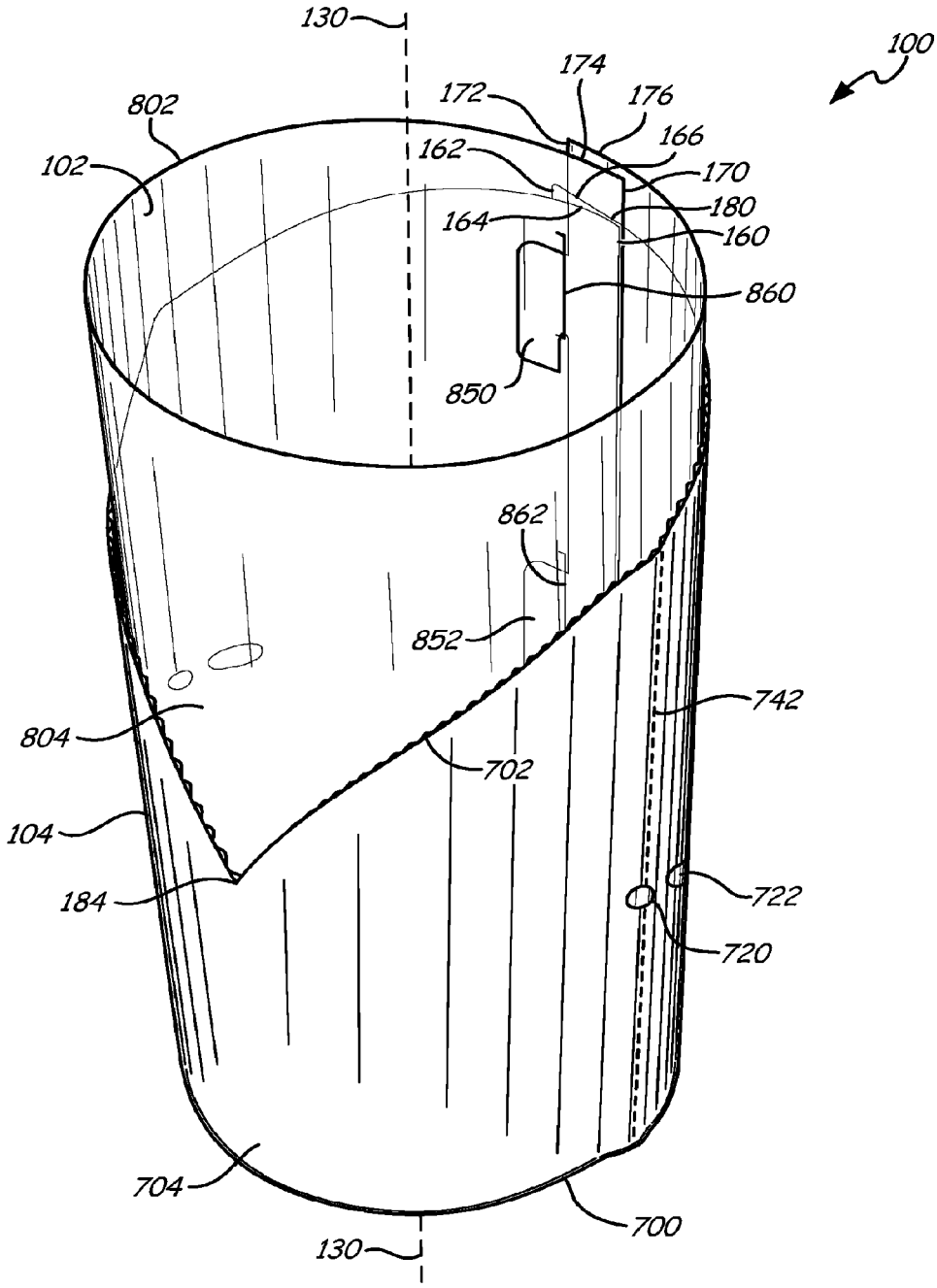
FIG. 1 is a front perspective view of a retail display apparatus, according to one embodiment.
Figure 2:
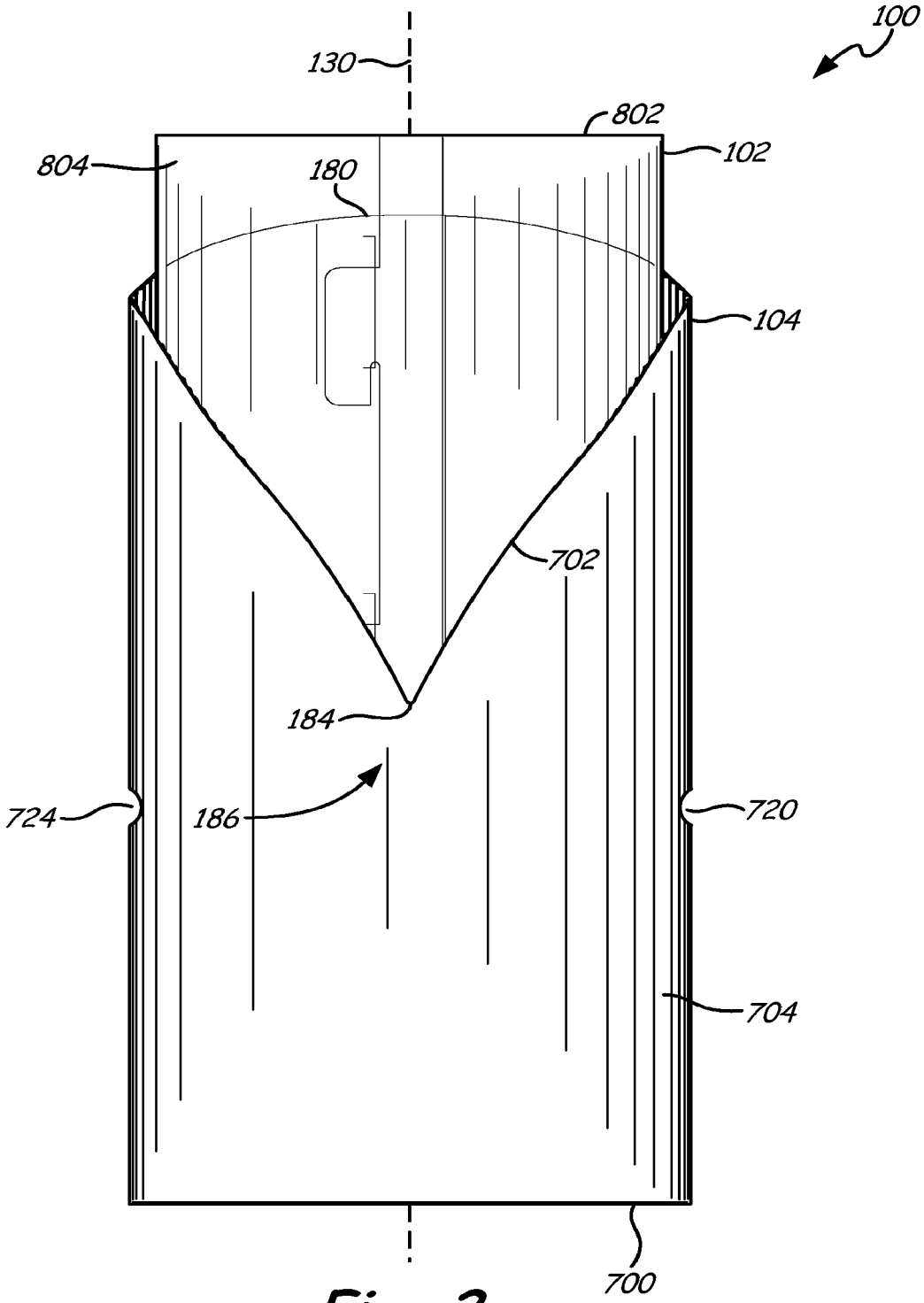
FIG. 2 is a front view of the retail display apparatus of FIG. 1.
Figure 3:
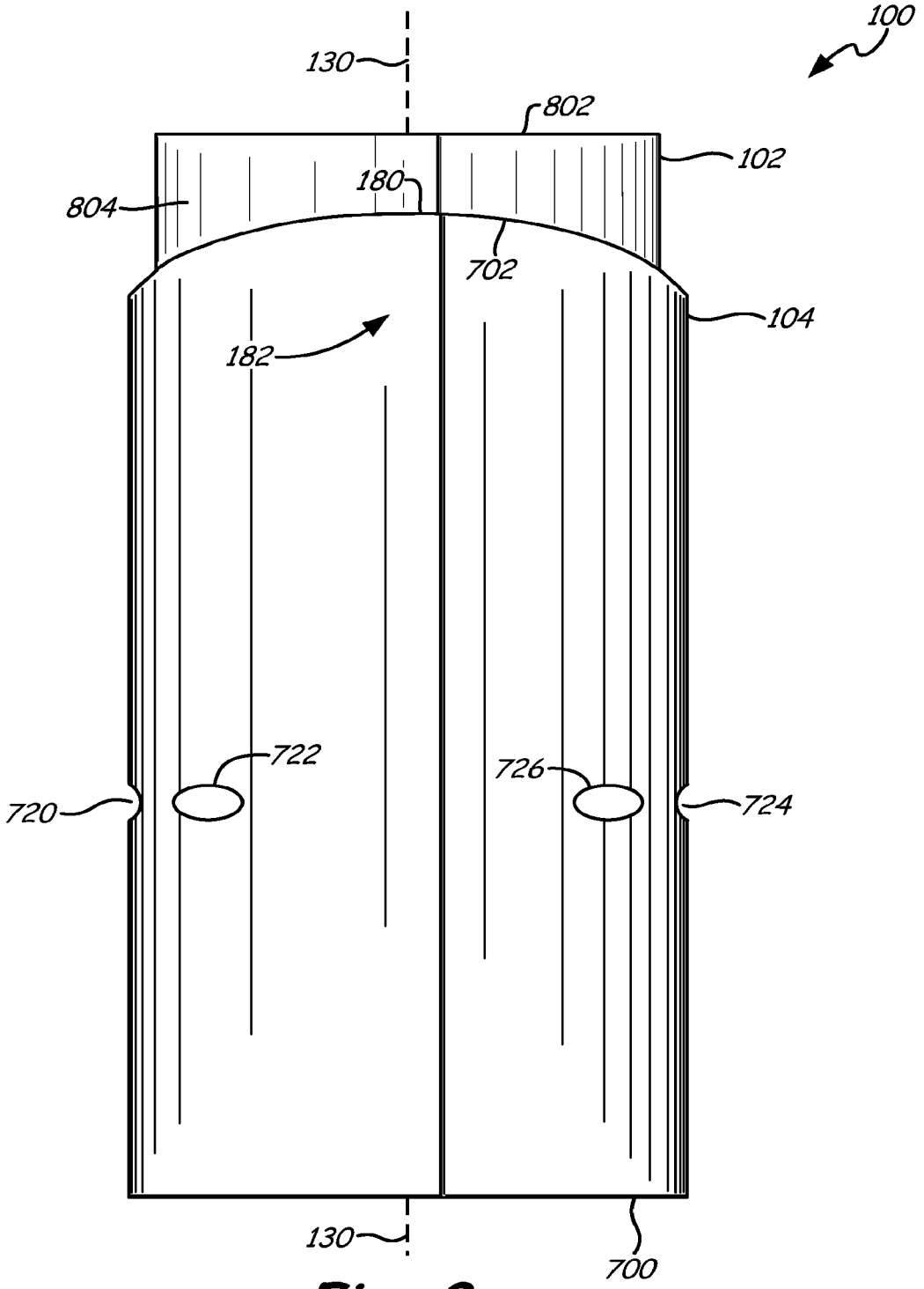
FIG. 3 is a back view of the retail display apparatus of FIG. 1.
Figure 4:
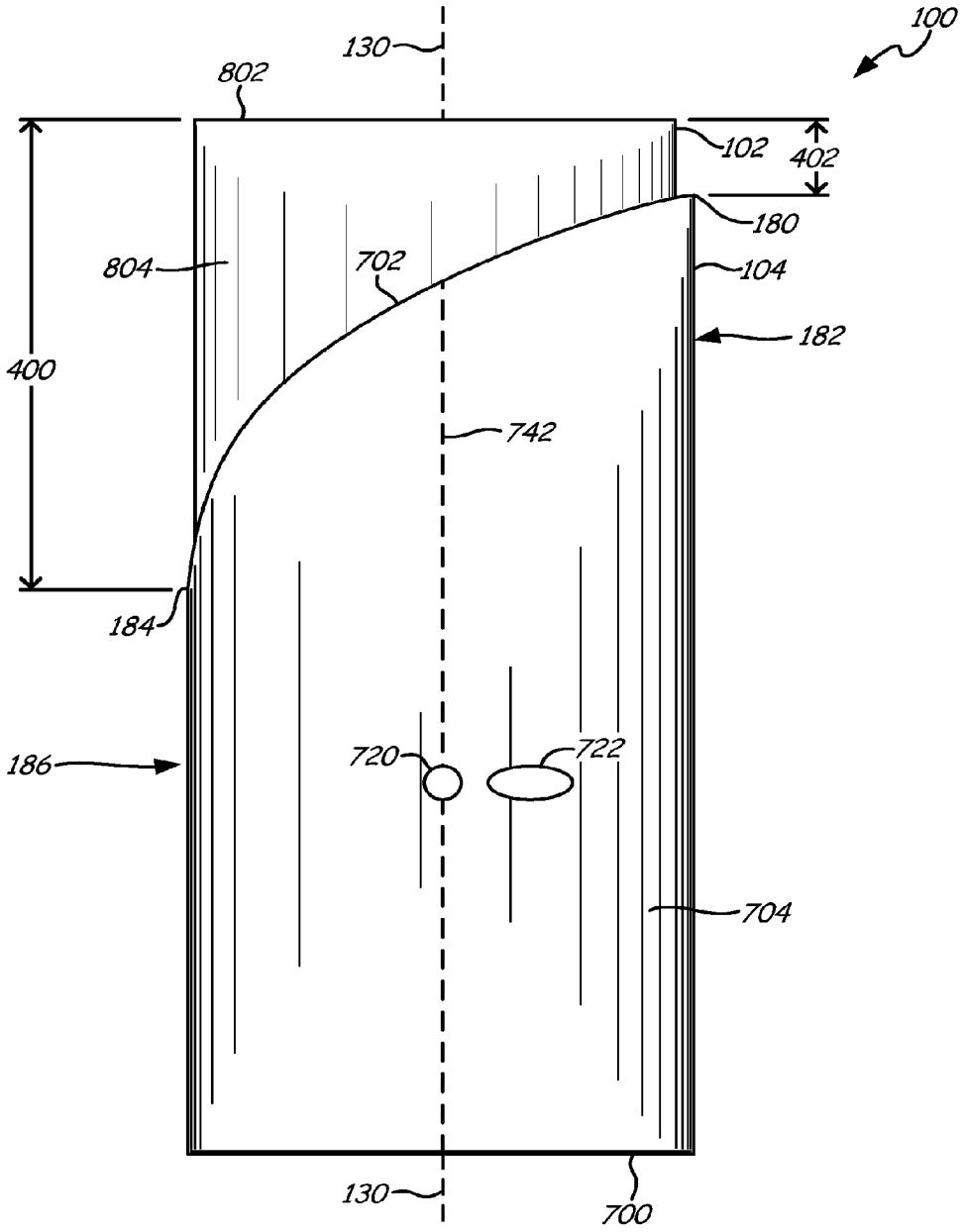
FIG. 4 is a right side view of the retail display apparatus of FIG. 1.
Figure 5:
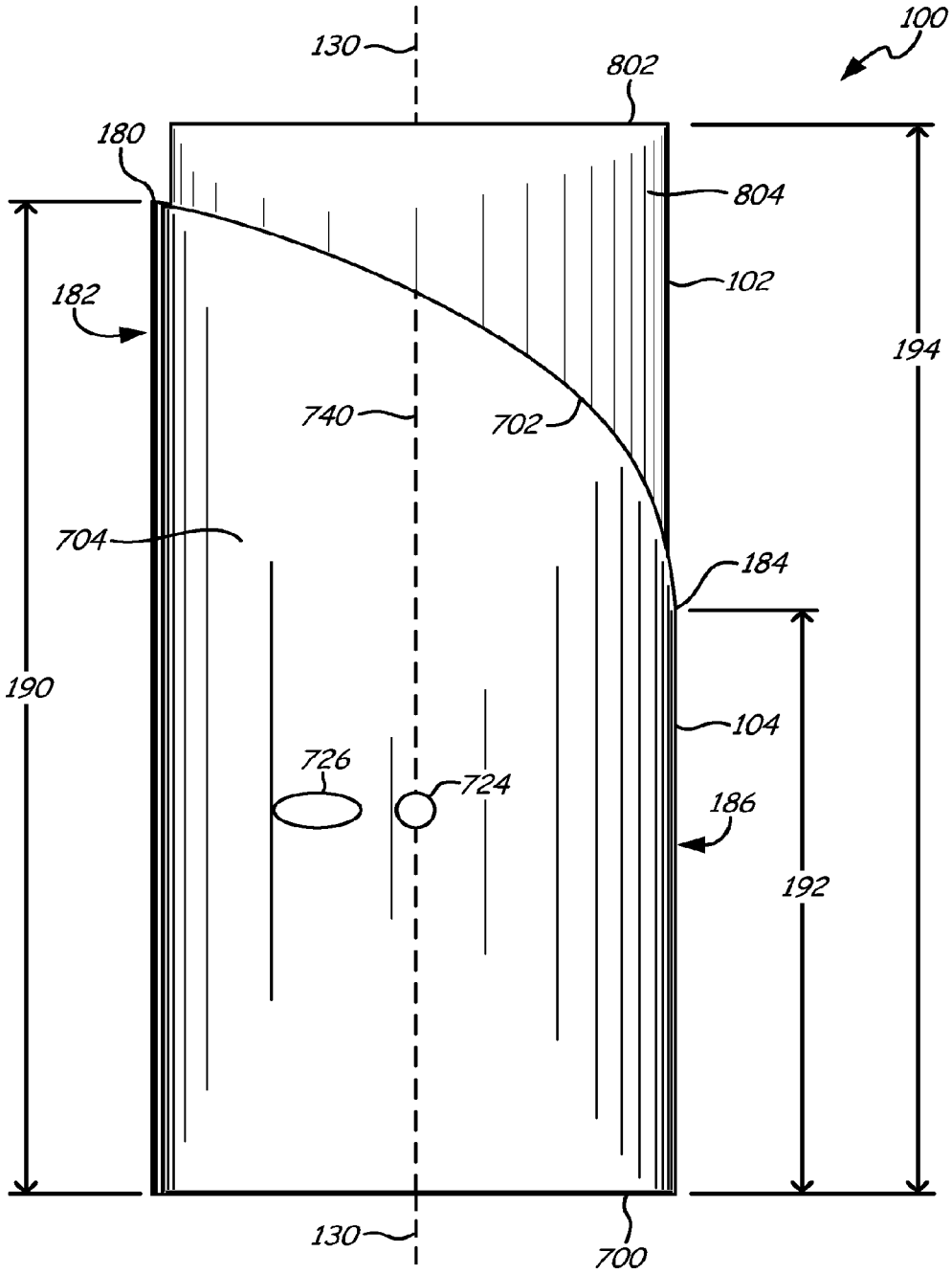
FIG. 5 is a left side view of the retail display apparatus of FIG. 1.

In some embodiments, outer sleeve 104 is constructed from a sheet material with a first side edge 160 (FIG. 1) and a second side edge 162 (FIG. 1). A first overlapping region 164 extends from first side edge 160 and a second overlapping region 166 extends from second side edge 162. First overlapping region 164 overlaps and is attached, adhered or bonded to second overlapping region 166. According to one embodiment, first overlapping region 164 is adhered to second overlapping region 166 by an adhesive.

In some embodiments, inner sleeve 102 is constructed from a sheet material with a first side edge 170 and a second side edge 172. A first overlapping region 174 extends from first side edge 170 and a second overlapping region 176 extends from second side edge 172. First overlapping region 174 overlaps second overlapping region 176. As shown in FIG. 8, second side edge 172 has three spaced apart locking tabs 850, 852 and 854 that pass through three respective slots 860, 862 and 864 formed in the sheet material of inner sleeve 102. Locking tabs 850, 852 and 854 have respective lower extensions 870, 872 and 874 that extend below slots 860, 862 and 864, respectively, such that locking tabs 850, 852 and 854 are locked into position within slots 860, 862 and 864.

Outer sleeve 104 has two openings 720 and 722 on its right side and two openings 724 and 726 on its left side. Inner sleeve 102 has openings 820 and 822 (FIG. 8) on its right side that correspond to openings 720 and 722, respectively, of outer sleeve 104 and openings 824 and 826 on its left side that correspond to openings 724 and 726, respectively, of outer sleeve 104. When assembled as shown in FIGS. 1-6, opening 720 is aligned with opening 820; opening 722 is aligned with opening 822; opening 724 is aligned with opening 824; and opening 726 is aligned with opening 826.

Outer sleeve 104 has two score lines 740 (FIG. 5) and 742 (FIG. 4) on opposing left and right sides of outer sleeve 104. Score lines 740 and 742 extend from top edge 702 to bottom edge 700 of outer sleeve 104 and permit outer sleeve 104 to be flattened or collapsed as discussed further below. According to various embodiments, score lines 740 and 742 are continuous scores, intermittent scores or perforations.

Figure 11:
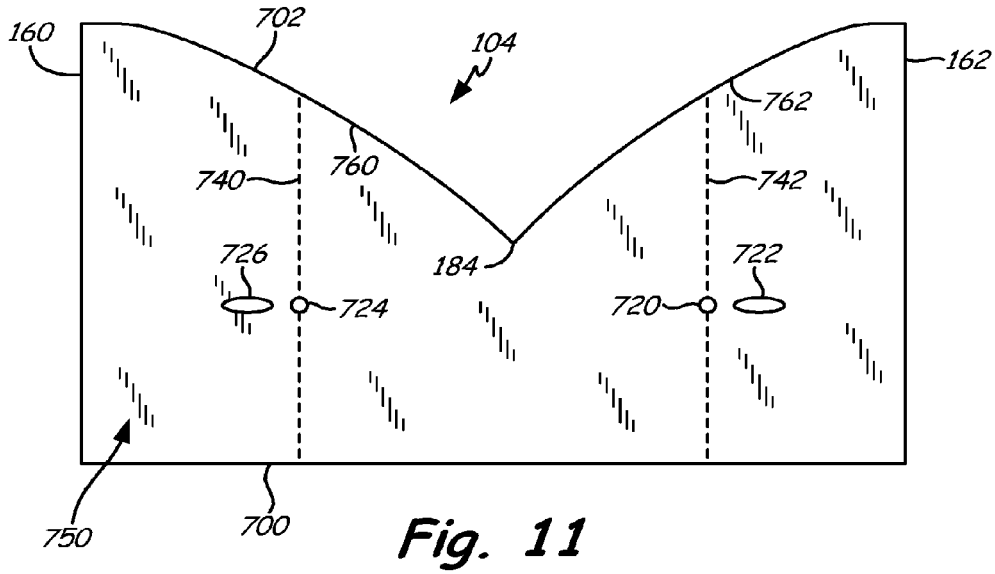
FIG. 11 is a plan view of an outer sleeve formed of a sheet material before it has been assembled into a tubular body.

FIG. 11 shows outer sleeve 104 formed of a sheet material before it has been assembled into a tubular body. According to one embodiment, outer sleeve 104 is formed of a paper material having a flat outer surface 750 and a corrugated inner surface 752 (FIG. 7) to provide additional vertical strength to outer sleeve 104 while still permitting outer sleeve 104 to be shaped into a tube or cylinder. The shape of outer sleeve 104 may be formed using cutting tools or a die. Although top edge 702 is shown as two smooth curves 760 and 762 that meet at point 184, other embodiments utilize more complex upper edge patterns.

Figure 12:
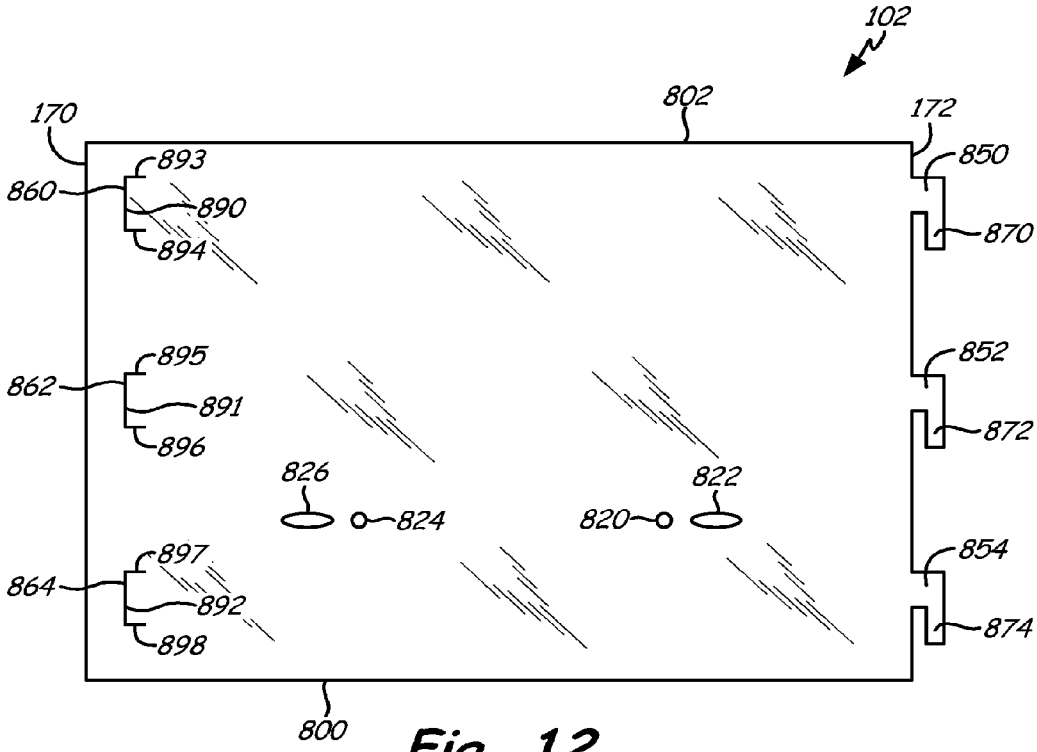
FIG. 12 is a plan view of an inner sleeve formed of a sheet material before it has been assembled into a tubular body.

FIG. 12 shows inner sleeve 102 formed of a sheet material before it is assembled into a tubular body. According to one embodiment, inner sleeve 102 is formed of a flexible transparent plastic sheet material. As shown in the embodiment of FIG. 12, slots 860, 862 and 864 have vertical segments 890, 891, and 892, respectively. Slot 860 further includes top horizontal segment 893 and bottom horizontal segment 894; slot 862 further includes top horizontal segment 895 and bottom horizontal segment 896; and slot 864 further includes top horizontal segment 897 and bottom horizontal segment 898. The vertical dimension of locking tabs 850, 852 and 854 with their respective lower extensions 870, 872 and 874 are longer than vertical segments 890, 891 and 892, respectively, such that locking tabs 850, 852 and 854 can be locked into position within slots 860, 862 and 864. The top and bottom horizontal segments of each of slots 860, 862 and 864 are provided to assist in inserting locking tabs 850, 852 and 854 in slots 860, 862 and 864.

Figure 13:
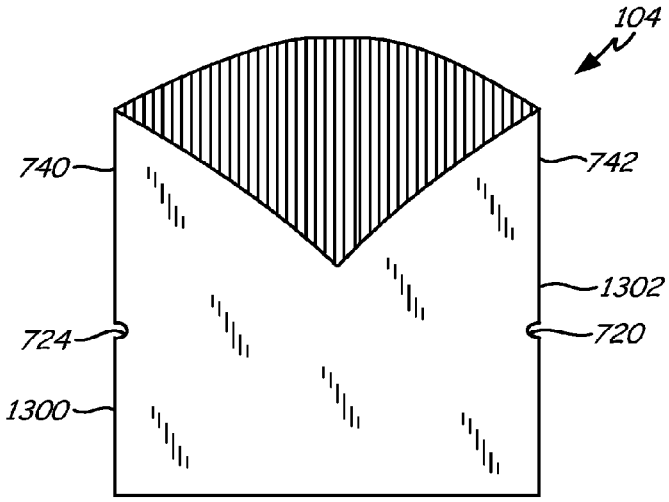
FIG. 13 is a front view of an outer sleeve in a flattened cylinder or flattened tubular state.
Figure 14:
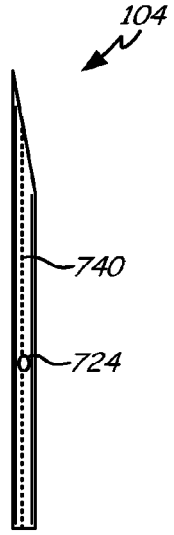
FIG. 14 is a left side view of the outer sleeve of FIG. 13 in a flattened cylinder or flattened tubular state.
Figure 15:
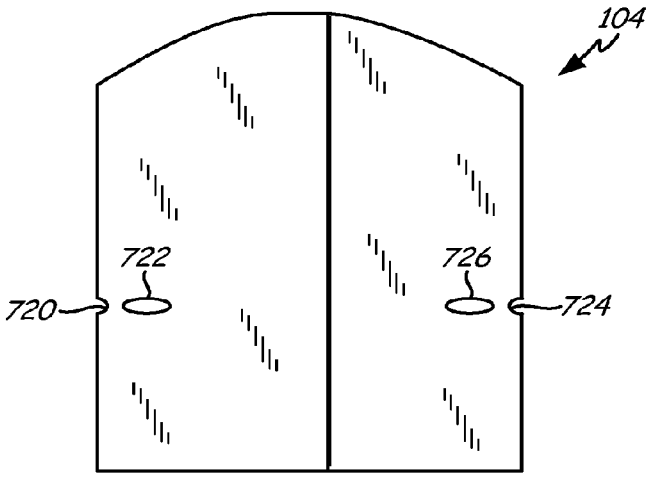
FIG. 15 is a back view of the outer sleeve of FIG. 13 in a flattened cylinder or flattened tubular state.
Figure 16:
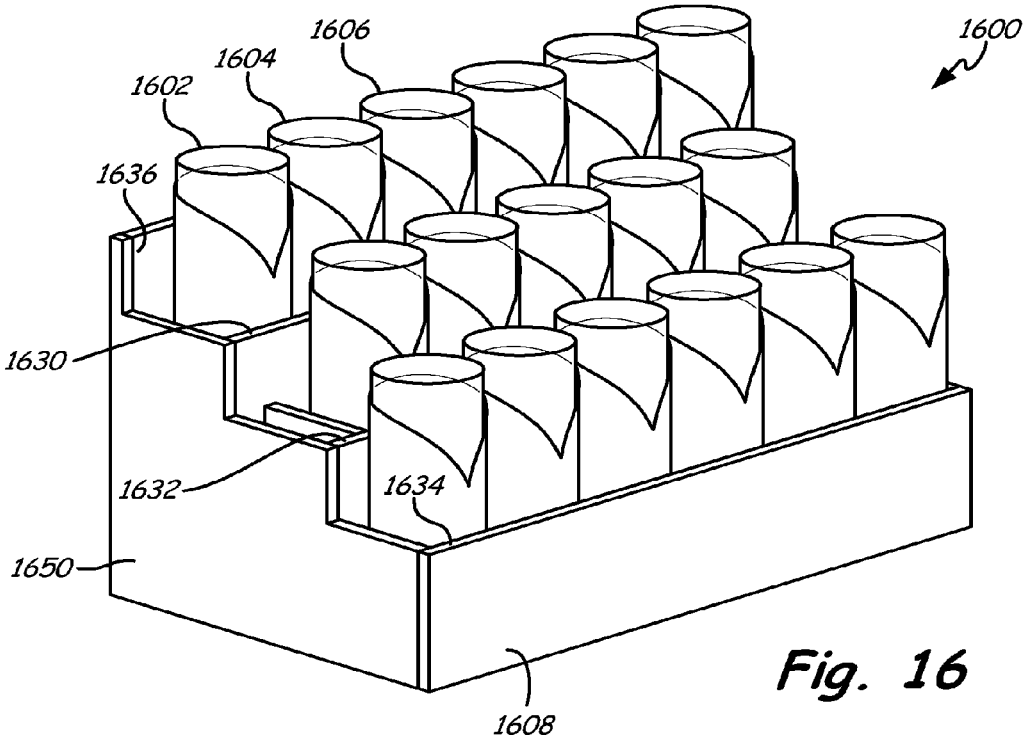
FIG. 16 is a perspective view of a container structure according to one embodiment.
Figure 17:
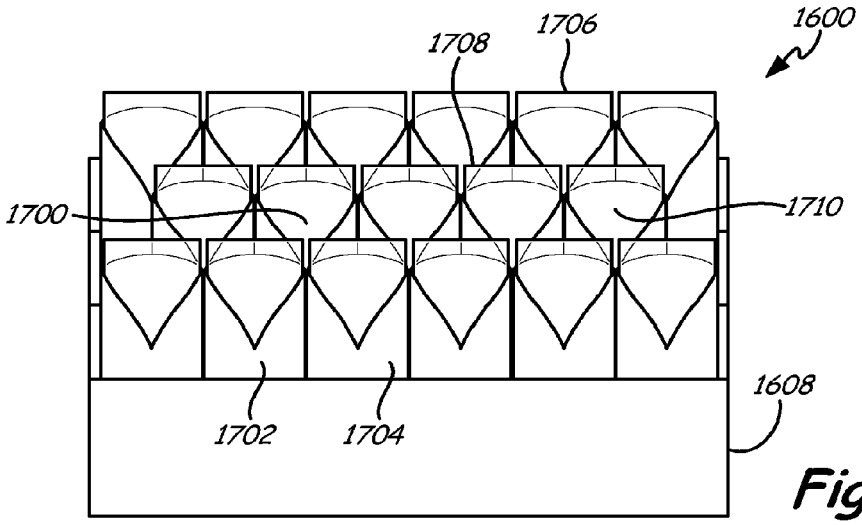
FIG. 17 is a front view of the container structure of FIG. 16.

FIGS. 13, 14 and 15 show a front view, a right side view and a back view of outer sleeve 104 in a flattened tubular or flattened cylindrical configuration. In FIGS. 13-15, outer sleeve 104 has been flattened by applying folds 1300 and 1302 along score lines 740 and 742, respectively. Score lines 740 and 742 permit outer sleeve 104 to be flattened. When score lines 740 and 742 take the form of perforations, they also facilitate returning outer sleeve 104 from a flattened tubular or flattened cylindrical configuration to a tubular or cylindrical configuration by reducing the amount of material of outer sleeve 104 that is actually folded.

According to one embodiment, display unit 100 is shipped to a retail establishment in a flattened state. In particular, outer sleeve 104 is shipped to the retail establishment in the flattened tubular or flattened cylindrical configuration shown in FIGS. 13-15 and inner sleeve 102 is shipped to the retail establishment in the flat sheet configuration shown in FIG. 12. At the retail establishment, display unit 100 is constructed by bending the sheet material of inner sleeve 102 into a tubular or cylindrical shape and inserting locking tabs 850, 852 and 854 into slots 860, 862, and 864 so that tabs 850, 852 and 854 maintain inner sleeve 102 in a tubular or cylindrical shape. Outer sleeve 104 is then converted from a flattened tubular body to a tubular cylinder by pulling the front 186 of outer sleeve 104 away from the back 182 of outer sleeve 104 to form an opening that outer sleeve 104 surrounds. Inner sleeve 102 is then inserted within the opening of outer sleeve 104, thereby providing support to outer sleeve 104.

Figure 18:
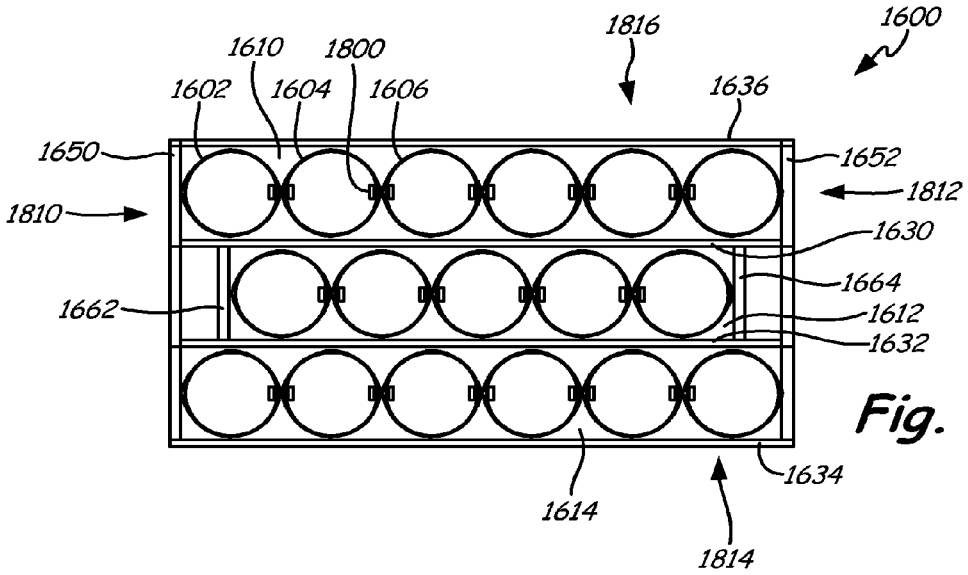
FIG. 18 is a top view of the container structure of FIG. 16.
Figure 19:
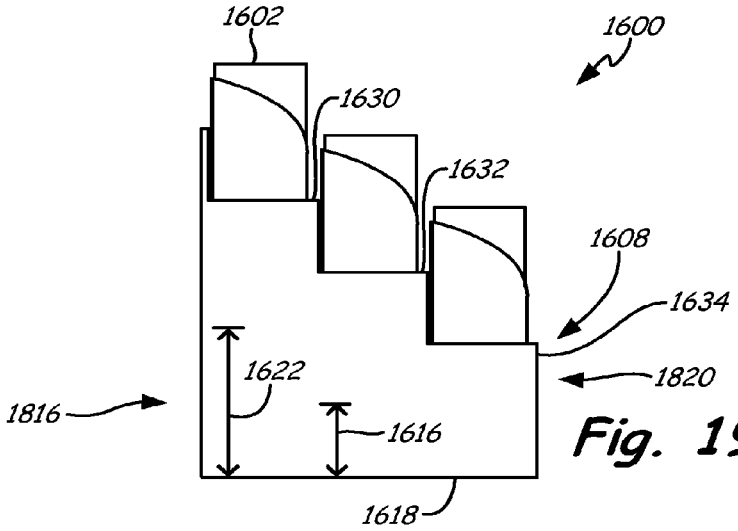
FIG. 19 is a left side view of the container structure of FIG. 16.
Figure 20:
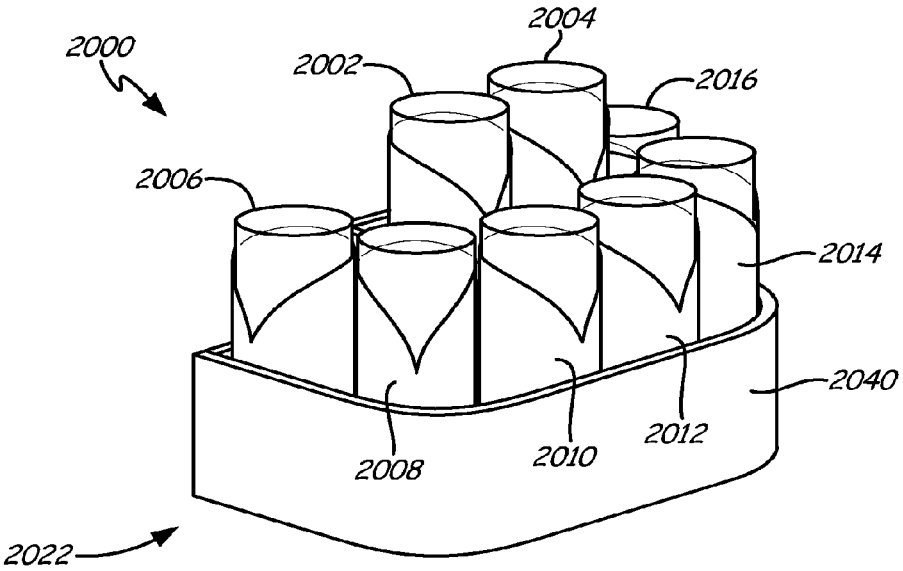
FIG. 20 is a perspective view of a container structure according to a further embodiment.
Figure 21:
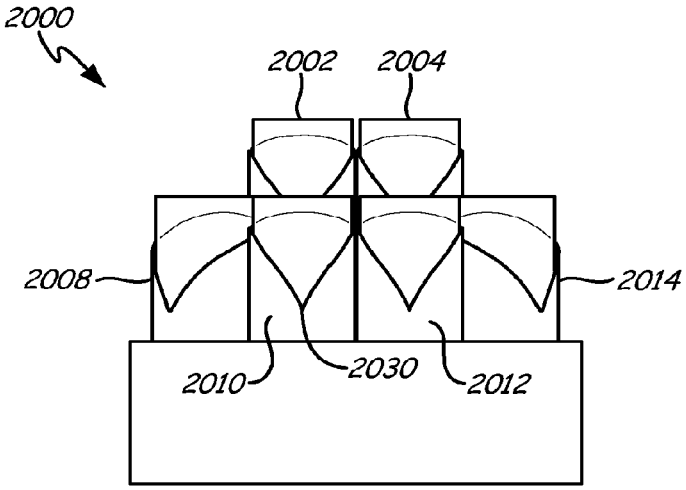
FIG. 21 is a front view of the container structure of FIG. 20.
Figure 22:
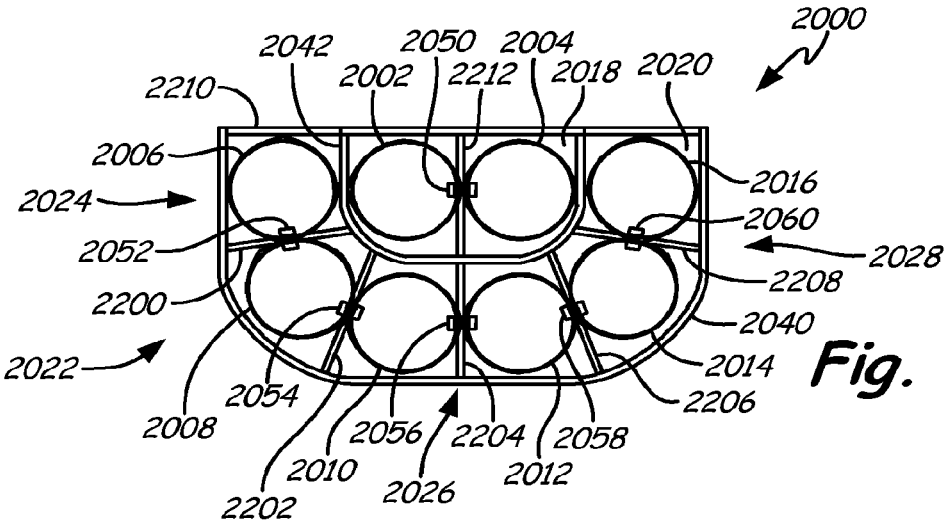
FIG. 22 is a top view of the container structure of FIG. 20.
Figure 23:
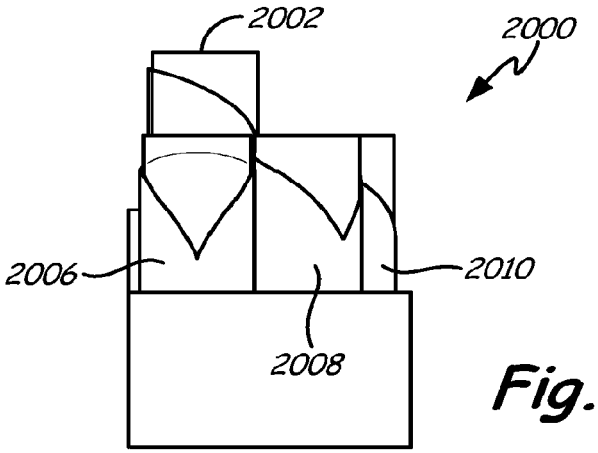
FIG. 23 is a left side view of the container structure of FIG. 20.
Figure 24:
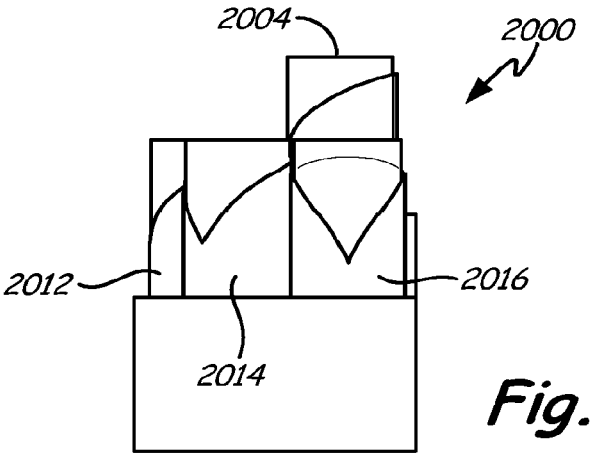
FIG. 24 is a right side view of the container structure of FIG. 20.
Figure 25:
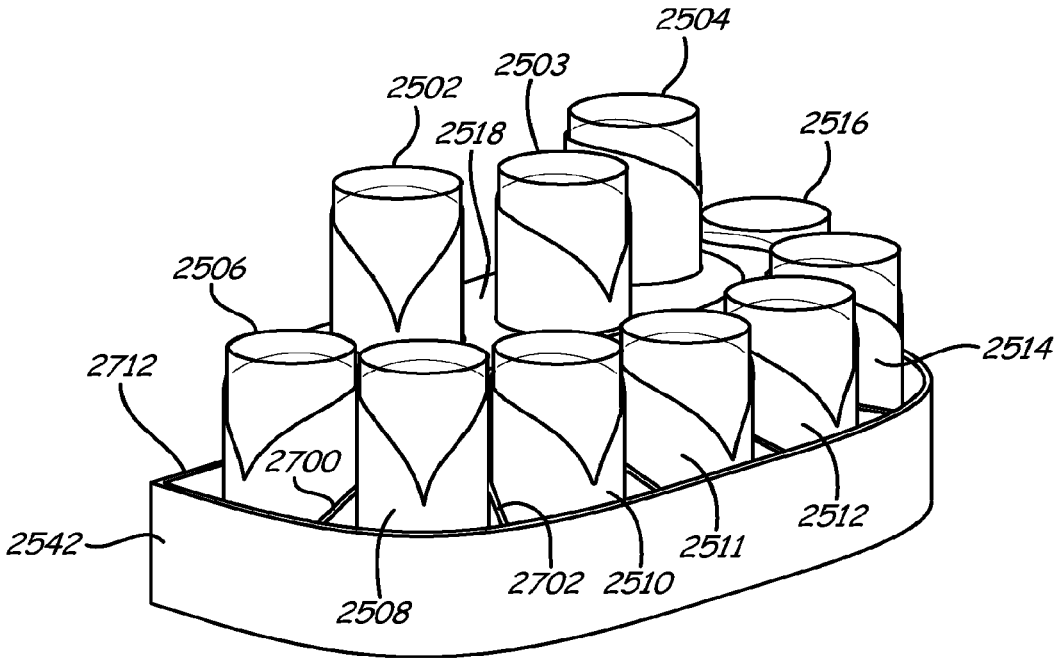
FIG. 25 provides a perspective view of a container structure according to another embodiment.
Figure 26:
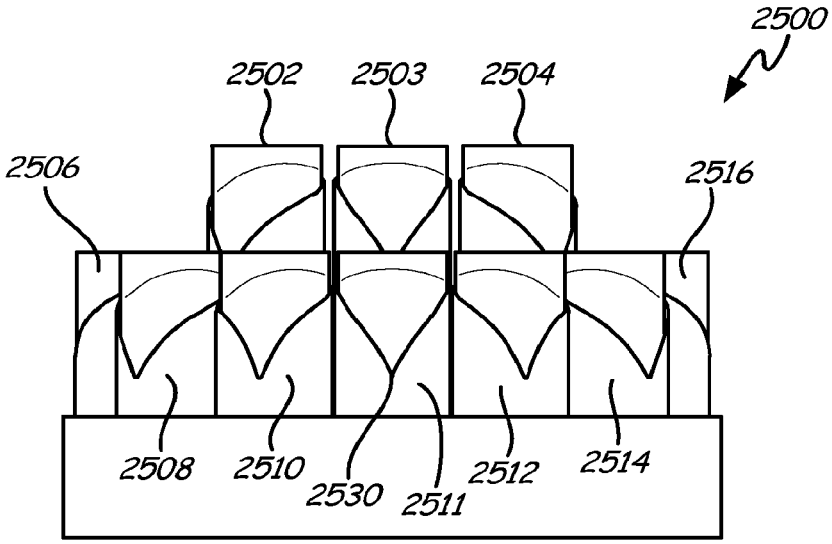
FIG. 26 provides a front view of the container structure of FIG. 25.
Figure 27:
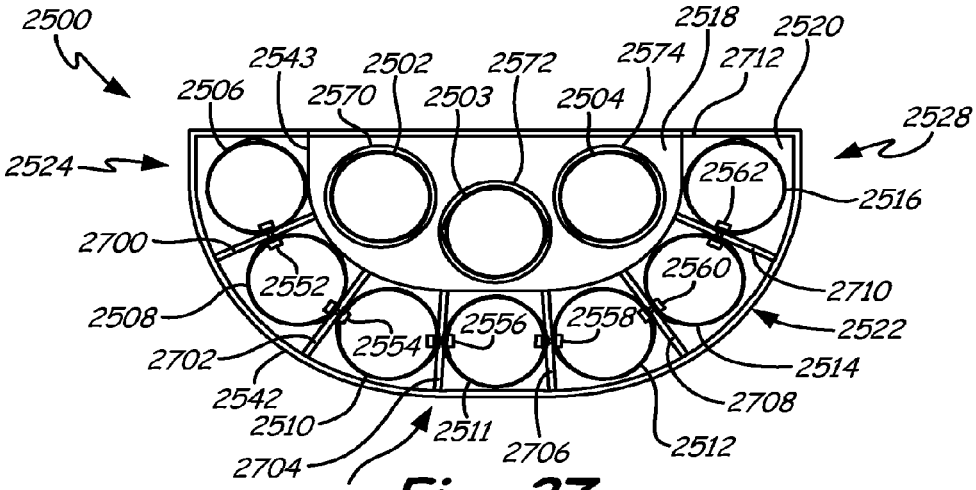
FIG. 27 provides a top view of the container structure of FIG. 25.
Figure 28:
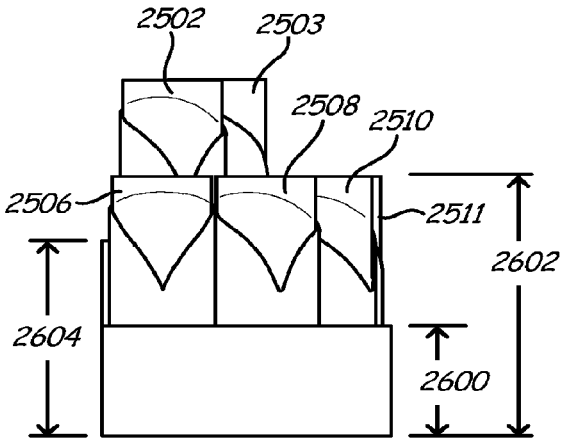
FIG. 28 provides a left side view of the container structure of FIG. 25.
Figure 29:
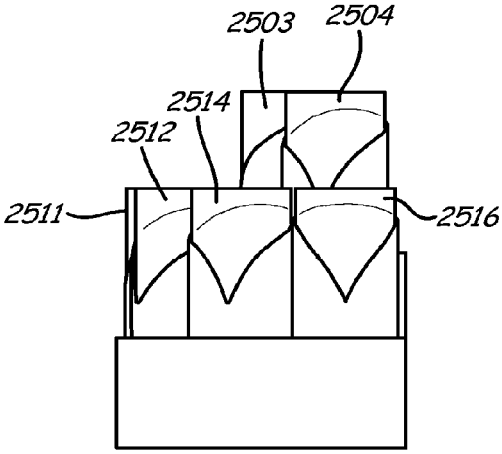
FIG. 29 provides a right side view of the container structure of FIG. 25.
Figure 30:
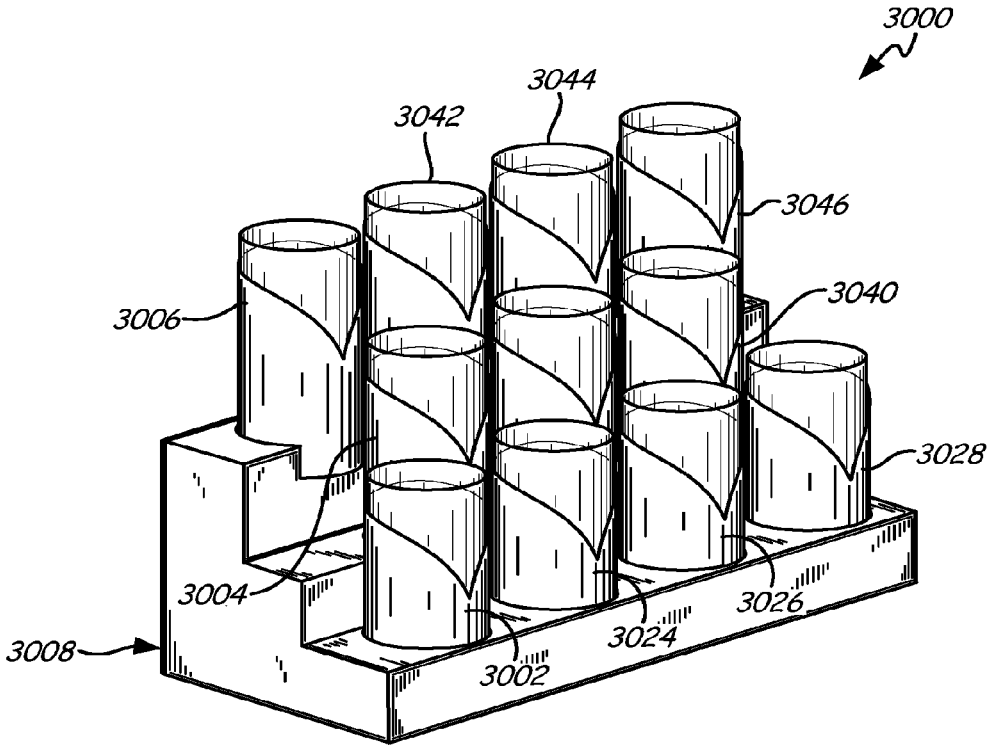
FIG. 30 provides a perspective view of a container structure according to another embodiment.
Figure 31:
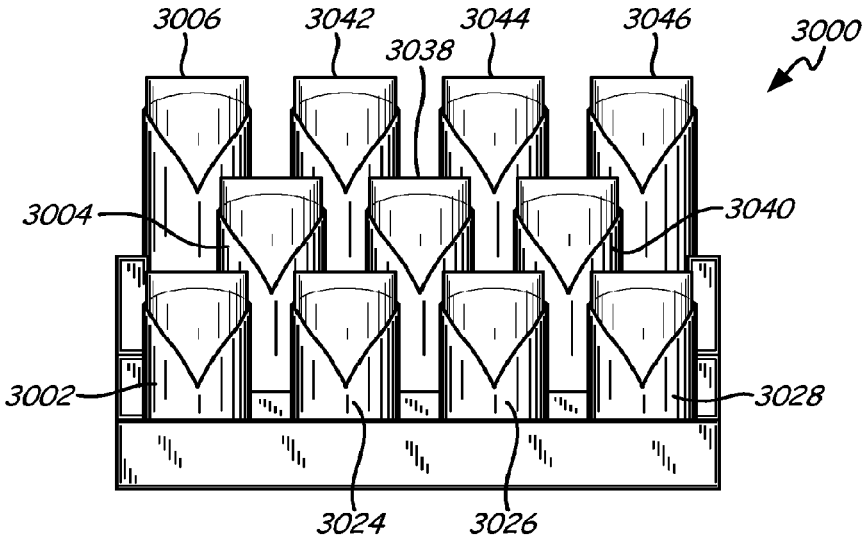
FIG. 31 provides a front view of the container structure of FIG. 30.
Figure 32:
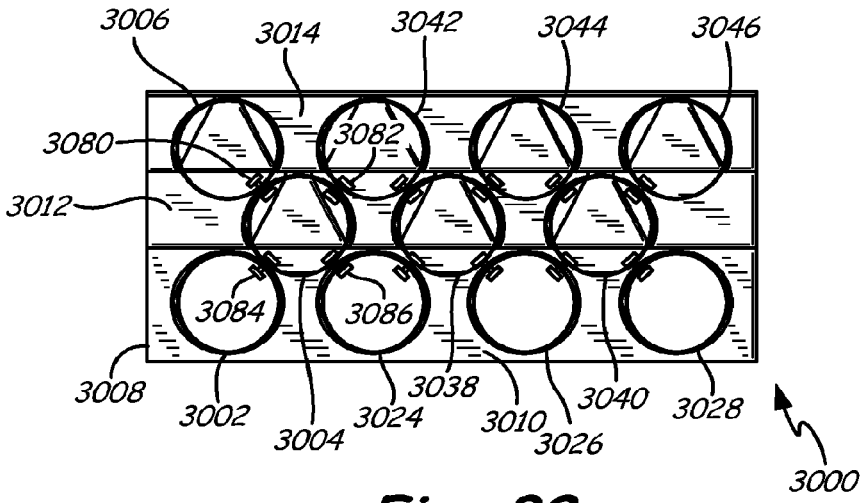
FIG. 32 provides a top view of the container structure of FIG. 30.
Figure 33:
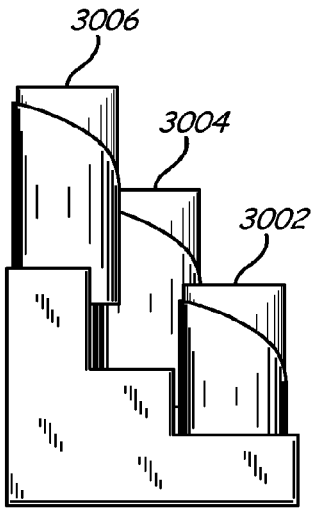
FIG. 33 provides a left side view of the container structure of FIG. 30.

FIGS. 16-19 provide a perspective view, a front view, a top view and a left side view, respectively, of a container structure 1600 having multiple display units connected together, such as display units 1602, 1604, and 1606, for example, and a stand or shelving unit 1608 that supports and/or contains the display units. Stand or shelving unit 1608 has a left side 1810 and an opposing a right side 1812, as well as a front 1814 and an opposing back 1816 (FIG. 18).

Stand or shelving unit 1608 provides three staggered shelves 1610, 1612 and 1614 (FIG. 18) on which display units are placed. Shelf 1614 is the lowest shelf and may be an integral part of stand 1608 or may be a shelf on which stand 1608 rests. Shelf 1614 is positioned in front of shelves 1612 and 1614. Shelf 1610 is the highest shelf at a height 1622 above a bottom 1618 of stand 1608 and is located behind shelves 1612 and 1614. Shelf 1612 is located between shelf 1614 and shelf 1610 and is at a height 1616 that is between bottom 1618 and height 1622.

Stand 1608 includes lateral walls 1630, 1632, 1634, and 1636 that extend laterally from left side 1810 (FIG. 18) to right side 1812 (FIG. 18). Lateral wall 1634 is in front of display units on shelf 1614, lateral wall 1632 is between the display units on shelf 1612 and the display units on shelf 1614, lateral wall 1630 is between the display units on shelf 1610 and the display units on shelf 1612, and lateral wall 1636 is behind the display units on shelf 1610. Stand 1608 also includes left side wall 1650 and right side wall 1652 that have tiered shapes with different heights for each shelf 1610, 1612 and 1614. In addition, shelf 1612 has spacer side walls 1662 and 1664 laterally set in from side walls 1650 and 1652.

The display units on shelf 1612 are laterally offset relative to the display units on shelf 1614. For example, display unit 1700 on shelf 1612 is positioned such that the center of display unit 1700 is aligned with the outer portions of display units 1702 and 1704 on shelf 1614 where display units 1702 and 1704 contact each other. Similarly, display unit 1706 on shelf 1610 is positioned such that the center of display unit 1706 is aligned with the outer portions of display units 1708 and 1710 on shelf 1612.

Display units within a shelf are connected together by fasteners. For example, display unit 1604 is connected to display unit 1606 by a fastener 1800 that passes through opening 820 in inner sleeve 102 of display unit 1604, opening 720 in outer sleeve 104 of display unit 1604, opening 724 in outer sleeve 104 of display unit 1606 and opening 824 in inner sleeve 102 of display unit 1606.

Although container structure 1600 in FIGS. 16-19 is shown to include seventeen display units, in other embodiments, different numbers of display units are provided in the container structure. In particular, some container structures may include as few as two display units fastened together by a fastener.

FIGS. 20-24 provide a perspective, front, top, left side and right side view, respectively, of a container structure 2000 according to another embodiment. Container structure 2000 has multiple display units 2002, 2004, 2006, 2008, 2010, 2012, 2014 and 2016 arranged on two shelves 2018 and 2020 of a stand or shelving unit 2022. In particular, display units 2002 and 2004 are positioned on shelf 2018 and display units 2006, 2008, 2010, 2012, 2014, and 2016 are arranged on shelf 2020.

Shelf 2018 is higher than shelf 2020, which extends around shelf 2018 from a left side 2024 of stand 2022 around a front 2026 of stand 2022 to a right side 2028 of stand 2022. As a result, display units 2002 and 2004 are raised relative to display units 2006, 2008, 2010, 2012, 2014, and 2016. Each display unit has a front marked by a low point in an outer sleeve of the display unit such as low point 2030 of display unit 2010. The fronts of display units 2002, 2004, 2010 and 2012 face outward from the front 2026 of stand 2022. The front of display unit 2006 faces outward from the left side 2024 of stand 2022 and the front of display unit 2016 faces outward from the right side 2028 of stand 2022. The front of display unit 2008 faces outward between the left side 2024 of stand 2022 and the front 2026 of stand 2022. The front of display unit 2014 faces outward between the right side 2028 of stand 2022 and the front 2026 of stand 2022.

Shelf 2020 has a wall 2040 and shelf 2018 has a wall 2042. Wall 2040 is shorter than a height of display units 2006, 2008, 2010, 2012, 2014, and 2016 and helps to maintain the display units on shelf 2020 without completely obscuring the display units. Similarly, wall 2042 is shorter than a height of display units 2002 and 2004 and helps to maintain display units 2002 and 2004 on shelf 2018 without completely obscuring display units 2002 and 2004. Wall 2040 has linear sections along left side 2024, front 2026 and right side 2028, where the linear sections along left side 2024 and front 2026 are connected by a curved section and the linear sections along right side 2028 and front 2026 are connected by a curved section. Similarly, wall 2042 has linear sections along left side 2024, front 2026 and right side 2028, where the linear sections along left side 2024 and front 2026 are connected by a curved section and the linear sections along right side 2028 and front 2026 are connected by a curved section.

Between wall 2040 and wall 2042 are compartment side walls 2200, 2202, 2204, 2206, and 2208. Each compartment side wall extends between two display units and has a top surface that is below a top of wall 2040. A back wall 2210 is also provided along the entire back of container structure 2000. Along shelf 2020, back wall 2210 has a height that substantially matches the height of wall 2040 and along shelf 2018, back wall 2210 has a height that substantially matches the height of wall 2042. Between wall 2042 and wall 2010 is a compartment side wall 2212, which extends between display units 2002 and 2004.

Display units 2002 and 2004 are connected together by a fastener 2050 passing through opening 820 in inner sleeve 102 of display unit 2002, opening 720 in outer sleeve 104 of display unit 2002, opening 724 in outer sleeve 104 of display unit 2004 and opening 824 in inner sleeve 102 of display unit 2004.

Display units 2006 and 2008 are connected together by a fastener 2052 passing through opening 820 in inner sleeve 102 of display unit 2006, opening 720 in outer sleeve 104 of display unit 2006, opening 726 in outer sleeve 104 of display unit 2008 and opening 826 in inner sleeve 102 of display unit 2008. According to this embodiment, fastener 2052 does not pass through openings 724 or 824 of display unit 2008 because display unit 2008 is rotated relative to display unit 2006.

Display units 2008 and 2010 are connected together by a fastener 2054 passing through opening 822 in inner sleeve 102 of display unit 2008, opening 722 in outer sleeve 104 of display unit 2008, opening 724 in outer sleeve 104 of display unit 2010 and opening 824 in inner sleeve 102 of display unit 2010. According to this embodiment, fastener 2054 does not pass through openings 720 or 820 of display unit 2008 because display unit 2008 is rotated relative to display unit 2010.

Display units 2010 and 2012 are connected together by a fastener 2056 passing through opening 820 in inner sleeve 102 of display unit 2010, opening 720 in outer sleeve 104 of display unit 2010, opening 724 in outer sleeve 104 of display unit 2012 and opening 824 in inner sleeve 102 of display unit 2012.

Display units 2012 and 2014 are connected together by a fastener 2058 passing through opening 820 in inner sleeve 102 of display unit 2012, opening 720 in outer sleeve 104 of display unit 2012, opening 726 in outer sleeve 104 of display unit 2014 and opening 826 in inner sleeve 102 of display unit 2014. According to this embodiment, fastener 2058 does not pass through openings 724 or 824 of display unit 2014 because display unit 2014 is rotated relative to display unit 2012.

Display units 2014 and 2016 are connected together by a fastener 2060 passing through opening 822 in inner sleeve 102 of display unit 2014, opening 722 in outer sleeve 104 of display unit 2014, opening 724 in outer sleeve 104 of display unit 2016 and opening 824 in inner sleeve 102 of display unit 2016. According to this embodiment, fastener 2060 does not pass through openings 720 or 820 of display unit 2014 because display unit 2014 is rotated relative to display unit 2016.

According to some embodiments, fasteners 2050, 2052, 2054, 2056, 2058 and 2060 are two-headed fasteners connected by a central member that passes through the openings in the display units. Examples of such fasteners include plastic snap rivets and plastic ratchet rivets that come in two parts, each with a head, and that are mated together by forcing a post on at least one of the parts into an opening in the other of the two parts. Each head of the two-headed fasteners is shaped such that at least one dimension of the head is larger than the opening in the display unit.

FIGS. 25-29 provide a perspective, front, top, left side and right side of a container structure 2500 according to another embodiment.

Container structure 2500 has multiple display units 2502, 2503, 2504, 2506, 2508, 2510, 2511, 2512, 2514 and 2516 arranged on two shelves 2518 and 2520 of a stand or shelving unit 2522. In particular, display units 2502, 2503 and 2504 are positioned within shelf 2518 and display units 2506, 2508, 2510, 2511, 2512, 2514, and 2516 are arranged on shelf 2520.

Shelf 2518 includes openings 2570, 2572, and 2574, in which display units 2502, 2503 and 2504 are respectively placed. Directly beneath shelf 2518 is a support (not shown) that is higher than shelf 2520 and that supports the bottoms of display units 2502, 2503, and 2504. As a result, display units 2502, 2503 and 2504 are raised relative to display units 2506, 2508, 2510, 2511, 2512, 2514, and 2516.

Shelf 2520 extends around shelf 2518 from a left side 2524 of stand 2522 around a front 2526 of stand 2522 to a right side 2528 of stand 2522. Shelf 2520 may be a part of stand 2522 or may be part of a shelf on which stand 2522 rests.

Each display unit has a front marked by a low point in an outer sleeve of the display unit such as low point 2530 of display unit 2511. The fronts of display units 2503, 2510 and 2512 face outward from the front 2526 of stand 2522. The front of display unit 2506 faces outward from the left side 2524 of stand 2522 and the front of display unit 2516 faces outward from the right side 2528 of stand 2522. The front of display units 2502, 2508 and 2510 face outward between the left side 2524 of stand 2522 and the front 2526 of stand 2522. The front of display units 2504, 2512 and 2514 face outward between the right side 2528 of stand 2522 and the front 2526 of stand 2522.

Stand 2522 includes a wall 2542 and a wall 2543. Wall 2542 has a height 2600 that is shorter than a height 2602 of display units 2506, 2508, 2510, 2511, 2512, 2514, and 2516 and helps to maintain the display units on shelf 2520 without completely obscuring the display units. Wall 2543 extends downwardly from the outer perimeter of shelf 2518 to the inner perimeter of shelf 2520.

Between wall 2542 and wall 2543 are compartment side walls 2700, 2702, 2704, 2706, 2708 and 2710. Each compartment side wall extends between two display units and has a top surface that is below a top of wall 2542. A back wall 2712 is also provided along the entire back of container structure 2500. Along shelf 2520, back wall 2712 has a height that substantially matches the height 2600 of wall 2542 and along shelf 2518, back wall 2712 has a height that substantially matches the height 2604 of shelf 2518.

Display units 2506 and 2508 are connected together by a fastener 2552 passing through opening 820 in inner sleeve 102 of display unit 2506, opening 720 in outer sleeve 104 of display unit 2506, opening 726 in outer sleeve 104 of display unit 2508 and opening 826 in inner sleeve 102 of display unit 2508. According to this embodiment, fastener 2552 does not pass through openings 724 or 824 of display unit 2508 because display unit 2508 is rotated relative to display unit 2506.

Display units 2508 and 2510 are connected together by a fastener 2554 passing through opening 822 in inner sleeve 102 of display unit 2508, opening 722 in outer sleeve 104 of display unit 2508, opening 726 in outer sleeve 104 of display unit 2510 and opening 826 in inner sleeve 102 of display unit 2510.

Display units 2510 and 2511 are connected together by a fastener 2556 passing through opening 822 in inner sleeve 102 of display unit 2510, opening 722 in outer sleeve 104 of display unit 2510, opening 724 in outer sleeve 104 of display unit 2511 and opening 824 in inner sleeve 102 of display unit 2511.

Display units 2511 and 2512 are connected together by a fastener 2558 passing through opening 820 in inner sleeve 102 of display unit 2511, opening 720 in outer sleeve 104 of display unit 2511, opening 724 in outer sleeve 104 of display unit 2512 and opening 824 in inner sleeve 102 of display unit 2512.

Display units 2512 and 2514 are connected together by a fastener 2560 passing through opening 822 in inner sleeve 102 of display unit 2512, opening 722 in outer sleeve 104 of display unit 2512, opening 726 in outer sleeve 104 of display unit 2514 and opening 826 in inner sleeve 102 of display unit 2514.

Display units 2514 and 2516 are connected together by a fastener 2562 passing through opening 822 in inner sleeve 102 of display unit 2514, opening 722 in outer sleeve 104 of display unit 2514, opening 724 in outer sleeve 104 of display unit 2516 and opening 824 in inner sleeve 102 of display unit 2516.

According to some embodiments, fasteners 2552, 2554, 2556, 2558, 2560, and 2562 are two-headed fasteners connected by a central member that passes through the openings in the display units. Examples of such fasteners include plastic snap rivets and plastic ratchet rivets that come in two parts, each with a head, and that are mated together by forcing a post on at least one of the parts into an opening in the other of the two parts. Each head of the two-headed fasteners is shaped such that at least one dimension of the head is larger than the opening in the display unit.

FIGS. 30-34 provide a perspective, front, top, left side and right side of a container structure 3000 according to another embodiment.

Container structure 3000 includes multiple display units connected together, such as display units 3002, 3004, and 3006, for example, and a stand or shelving unit 3008 that supports the display units.

Figure 35:
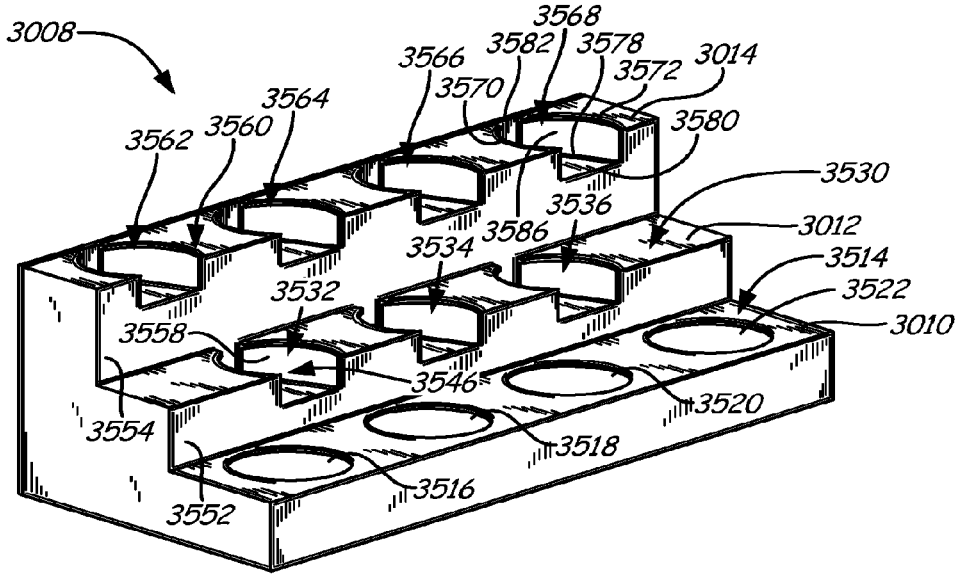
FIG. 35 provides a perspective view of the stand of FIG. 30 with the display units removed.
Figure 36:
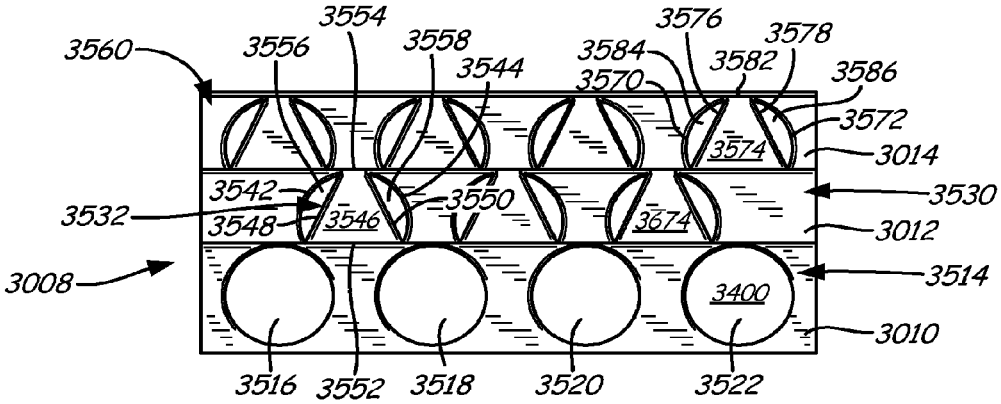
FIG. 36 provides a top view of the stand of FIG. 35.

FIGS. 35 and 36 show a perspective and top view, respectively of stand or shelving unit 3008 with the display units removed. As shown in FIGS. 35 and 36, stand or shelving unit 3008 provides three staggered tiers 3010, 3012 and 3014 which support display units. Tier 3010 includes a shelf 3514 with openings 3516, 3518, 3520 and 3522 into which display units 3002, 3024, 3026, and 3028, respectively, are inserted. According to one embodiment, openings 3516, 3518, 3520, and 3522 have a perimeter shape that substantially matches a perimeter shape of display units 3002, 3024, 3026, and 3028, respectively. According to one embodiment, openings 3516, 3518, 3520 and 3522 are through holes to a bottom of stand 3008.

Tier 3012 includes a shelf 3530 with recesses 3532, 3534, and 3536 into which display units 3004, 3038 and 3040, respectively, are inserted. Recess 3532 is defined by two curved edges 3542 and 3544 of shelf 3530 and a bottom support panel 3546. Bottom support panel 3546 has straight side edges 3548 and 3550 that extend from a wall 3552 to a wall 3554. Under one embodiment, straight side edges 3548 and 3550 are not oriented normal to wall 3552. Instead, straight side edges 3548 and 3550 angle toward each other from wall 3552 to wall 3554. A space 3556 is between a portion of curved edge 3542 and straight edge 3548. According to one embodiment, there is no material in space 3556 so that space 3556 is an opening in stand 3008. Similarly, a space 3558 is between a portion of straight side edge 3550 and curved edge 3544. According to one embodiment, there is no material in space 3558 so that space 3558 is an opening in stand 3008. Recesses 3534 and 3536 have similar shapes and features to recess 3532.

Tier 3014 includes a shelf 3560 with recesses 3562, 3564, 3566 and 3568 into which display units 3006, 3042, 3044 and 3046, respectively, are inserted. Recess 3568 is defined by two curved edges 3570 and 3572 of shelf 3560 and a bottom support panel 3574. Bottom support panel 3574 has straight side edges 3576 and 3578 that extend from wall 3554 to wall 3582. Under one embodiment, straight side edges 3576 and 3578 are not oriented normal to wall 3554. Instead, straight edges 3576 and 3578 angle toward each other from front wall 3554 to wall 3582. A space 3584 is between a portion of curved edge 3570 and straight edge 3576. According to one embodiment, there is no material in space 3584 so that space 3584 is an opening in stand 3008. Similarly, a space 3586 is between a portion of straight side edge 3578 and curved edge 3572. According to one embodiment, there is no material in space 3586 so that space 3586 is an opening in stand 3008. Recesses 3562, 3564 and 3566 have similar shapes and features to recess 3568.

Figure 34:
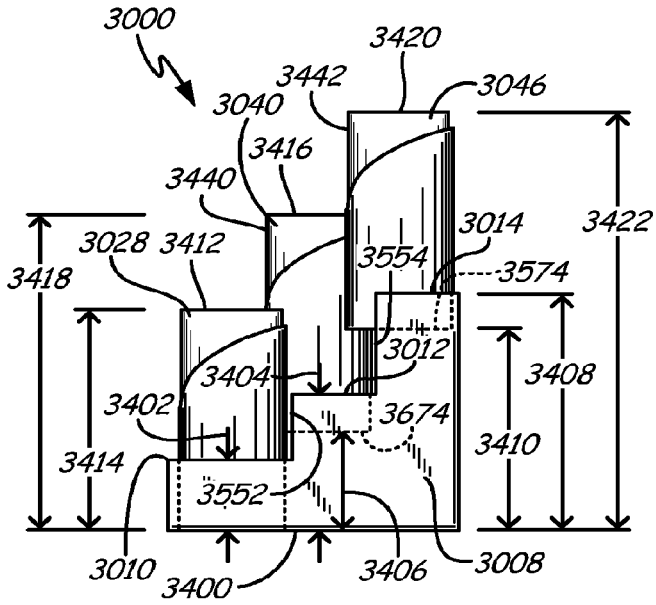
FIG. 34 provides a right side view of the container structure of FIG. 30.

As shown in FIG. 34, display unit 3028 rests on a bottom 3400. Bottom 3400 may be part of shelving unit 3008 or may be a shelf of a separate shelving unit that shelving unit 3008 rests upon. Shelf 3010 is a height 3402 above bottom 3400. According to one embodiment, height 3402 is approximately 6 inches (15.24 cm). Shelf 3012 is a height 3404 above bottom 3400 and the bottom support panel 3674 of recess 3536 is at a height 3406 above bottom 3400. According to one embodiment, height 3406 is 8.375 inches (21.27 cm). Shelf 3014 is a height 3408 above bottom 3400 and the bottom support panel 3574 of recess 3568 is at a height 3410 above bottom 3400. According to one embodiment, height 3410 is 16.75 inches (42.55 cm). Because the display units on tiers 3010, 3012, and 3014 rest on supports that are at different heights, the top 3412 of display unit 3028 is at a first height 3414 above bottom 3400; the top 3416 of display unit 3040 is at a second height 3418 above bottom 3400; and the top 3420 of display unit 3046 is at a third height 3422 above bottom 3400. According to one embodiment, first height 3414 is approximately 30 inches (76.2 cm), second height 3418 is approximately 38.375 inches (97.47 cm) and third height 3422 is approximately 46.75 inches (118.75 cm).

As shown in FIG. 34, the front 3440 of display unit 3040 extends past wall 3552. Thus, bottom support panel 3674 does not contact the entire bottom of display unit 3040. Similarly, the front 3442 of display unit 3046 extends past wall 3554. Thus, bottom support panel 3574 does not contact the entire bottom of display unit 3046.

The display units on tier 3012 are laterally offset relative to the display units on tiers 3010 and 3014, while the display units on tiers 3010 and 3014 are laterally aligned with each other. For example, display unit 3004 on tier 3012 is positioned such that the center of display unit 3004 is aligned midway between the space between display unit 3002 and display unit 3024 and midway between the space between display unit 3006 and display unit 3042.

Each display unit is connected or attached to at least one other display unit on a different tier by a fastener. Display units on tier 3012 are connected or attached to four other display units: two on tier 3014 and two on tier 3010. For example, display unit 3004 on tier 3012 is connected to display units 3006 and 3042 on tier 3014 by fasteners 3080 and 3082, respectively, and is connected to display units 3002 and 3024 on tier 3010 by fasteners 3084 and 3086, respectively. To permit fasteners to connect display units on one tier to display units on another tier, the display units of FIGS. 30-34 have different fastener openings than those shown in FIGS. 1-15. In particular, the display units of FIGS. 30-34 have front openings on both sides of the front center and located forty-five degrees from the front center of the display unit as well as back openings on both sides of the back center and located forty-five degrees from the back center. The front openings are at a different height from the bottom of the display unit than the back openings. According to one embodiment, the front openings are 8.375 inches (21.27 cm) lower than the back openings. The front openings and the back openings may be any desired shape including circular, elliptical, oblong, and polygonal.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A retail display unit comprising:

a single piece of first sheet material having a top edge, a bottom edge, and side edges that are attached together to form a first tubular body and first and second score lines that are spaced apart from the side edges and extend from the top edge to the bottom edge of the first sheet material, wherein the first and second score lines are located on opposing sides of the first tubular body to facilitate the first tubular body being folded at the first and second score lines to place the first tubular body in a flattened state and being unfolded at the first and second score lines for placing the first tubular body in a cylindrical state; and a single piece of second sheet material, formable into a second tubular body by attaching side edges of the second sheet of material together, wherein the second tubular body fits within the first tubular body when the first tubular body is in the cylindrical state;

and wherein the first sheet material comprises at least one opening and the second sheet material comprises at least one opening such that when the second tubular body fits within the first tubular body, the at least one opening of the first sheet material aligns with the at least one opening of the second sheet material;

and comprising a fastener adapted to pass through the at least one opening in the first sheet of material and the at least one opening in the second sheet of material to attach the retail display unit to a second retail display unit.

2. The retail display unit of claim 1 wherein the top edge of the first tubular body is shaped differently than the bottom edge of the first tubular body.

3. The retail display unit of claim 2 wherein at least part of the second tubular body extends past the top edge of the first tubular body and a bottom edge of the second tubular body is aligned with the bottom edge of the first tubular body when the second tubular body fits within the first tubular body.

4. The retail display unit of claim 1 wherein the second sheet material is formed of a transparent material and the first sheet material is formed of an opaque material.

5. The retail display unit of claim 1 wherein the second sheet material is adapted to be formed into the second tubular body by at least one slot and at least one locking tab on the second sheet material.

6. The retail display unit of claim 1 wherein the first tubular body comprises a height defined between the bottom edge and the top edge of the first sheet material that is non-uniform and wherein the second tubular body comprises a height that is uniform.

7. A container structure comprising:

a first container comprising:

a first transparent inner cylinder that surrounds a first open space and includes a top edge, a bottom edge and a uniform height;

a first outer sleeve encircling the first transparent inner cylinder and including a top edge, a bottom edge and a non-uniform height that is less than the uniform height of the first transparent inner cylinder, wherein the top edge of the first outer sleeve includes a single low point that has a height that is less than a height of a remainder of the first outer sleeve;

a second container comprising:

a second transparent inner cylinder that surrounds a second open space and includes a top edge, a bottom edge and a uniform height;

a second outer sleeve encircling the second transparent inner cylinder and including a top edge, a bottom edge and a non-uniform height that is less than the uniform height of the second transparent inner cylinder, wherein the top edge of the second outer sleeve includes a single low point that has a height that is less than a height of a remainder of the second outer sleeve;

and a stand comprising at least a first shelf and a second shelf located above the first shelf, wherein the bottom edges of the first transparent inner cylinder and the first outer sleeve rest on the first shelf and the bottom edges of the second transparent inner cylinder and the second outer sleeve rest on the second shelf so that the top edge of the second transparent inner sleeve is at a height that is greater than the top edge of the first transparent inner cylinder and wherein the first inner cylinder comprises at least one opening and the first outer sleeve comprises at least one opening such that when the first inner cylinder fits within the first outer sleeve, the at least one opening of the first inner cylinder aligns with the at least one opening of the first outer sleeve;

and wherein the second inner cylinder comprises at least one opening and the second outer sleeve comprises at least one opening such that when the second inner cylinder fits within the second outer sleeve, the at least one opening of the second inner cylinder aligns with the at least one opening of the second outer sleeve;

and comprising a fastener adapted to pass through the at least one opening in the first inner cylinder and the first outer sleeve of the first container and the at least one opening in the second outer sleeve and the second inner cylinders of the second container to attach the first container to the second container.

8. The container structure of claim 7 wherein the first outer sleeve comprises first and second lines of perforations located on opposite sides of the first outer sleeve from each other and wherein the second outer sleeve comprises first and second lines of perforations located on opposite sides of the second outer sleeve from each other, each of the first line of perforations and the second line of perforations of the first outer sleeve extend from the top edge of the first outer sleeve to the bottom edge of the first outer sleeve and each of the first line of perforations and the second line of perforations of the second outer sleeve extend from the top edge of the second outer sleeve to the bottom edge of the second outer sleeve.

9. The container structure of claim 7 wherein the top edge of the first transparent inner cylinder extends above the top edge of the first outer sleeve and the top edge of the second transparent inner cylinder extends above the top edge of the second outer sleeve.

10. The container structure of claim 7 wherein the first outer sleeve comprises a single sheet of material having side edges that are attached together, a front and a back, wherein the single low point of the top edge of the first outer sleeve is located at the front of the first outer sleeve and the attached side edges of the first outer sleeve are located at the back of the first outer sleeve.

11. The container structure of claim 7 wherein the second outer sleeve comprises a single sheet of material having side edges that are attached together, a front and a back, wherein the single low point of the top edge of the second outer sleeve is located at the front of the second outer sleeve and the attached side edges of the second outer sleeve are located at the back of the second outer sleeve.

12. The container structure of claim 7 wherein the stand further comprises a first wall that defines a front of the first shelf and a second wall that defines a front of the second shelf, wherein the first container is positioned between the first wall and the second wall on the first shelf and the second container is positioned behind the second wall and on the second shelf.

13. A container structure comprising:

a first container comprising:

a first transparent inner sleeve that surrounds a first open space and includes a uniform height;

a first outer sleeve encircling the first transparent inner sleeve and including a non-uniform height that is less than the uniform height of the first transparent inner sleeve and first and second lines of perforations extending from a top edge of the first outer sleeve to a bottom edge of the first outer sleeve and being located opposite each other along the first outer sleeve, wherein the top edge of the first outer sleeve includes a single low point that has a height that is less than a height of a remainder of the first outer sleeve and wherein the first and second lines of perforations are located between the single low point of the first outer sleeve and side edges that are attached together to form the first outer sleeve;

a second container comprising:

a second transparent inner sleeve that surrounds a second open space and includes a uniform height;

a second outer sleeve encircling the second transparent inner sleeve and including a non-uniform height that is less than the uniform height of the second transparent inner sleeve and first and second lines of perforations extending from a top edge of the second outer sleeve to a bottom edge of the second outer sleeve and being located opposite each other along the second outer sleeve, wherein the top edge of the second outer sleeve includes a single low point that has a height that is less than a height of a remainder of the second outer sleeve and wherein the first and second lines of perforations are located between the single low point of the second outer sleeve and side edges that are attached together to form the second outer sleeve; and at least one fastener passing through the first outer sleeve, the first transparent inner sleeve, the second outer sleeve and the second transparent inner sleeve to fasten the first container to the second container.

14. The container structure of claim 13 wherein the first transparent inner sleeve and the second transparent inner sleeve are each made of a single piece of sheet material and are each formed into a cylindrical shape by attaching side edges of the single piece of sheet material together.

15. The container structure of claim 14 wherein the first outer sleeve and the second outer sleeve are each made of a single piece of sheet material and are each formed into a cylindrical shape by attaching the side edges of the single piece of sheet material together.

16. The container structure of claim 15 wherein the first transparent inner sleeve comprises at least one opening and wherein the first outer sleeve comprises at least one opening that is different from the first and second lines of perforations, wherein the at least one opening in the first transparent sleeve aligns with the at least one opening in the first outer sleeve.

17. The container structure of claim 16 wherein the second transparent inner sleeve comprises at least one opening and wherein the second outer sleeve comprises at least one opening that is different from the first and second lines of perforations, wherein the at least one opening in the second transparent sleeve aligns with the at least one opening in the second outer sleeve.

18. The container structure of claim 17 wherein the aligned openings in the first transparent inner sleeve and the first outer sleeve align with the aligned openings in the second transparent inner sleeve and the second outer sleeve to receive the fastener.

* * * * *